US010502518B2

(12) United States Patent
McPherson et al.

(10) Patent No.: US 10,502,518 B2
(45) **Date of Patent: *Dec. 10, 2019**

(54) CROSSBOW COCKING CRANK

(71) Applicant: MCP IP, LLC, Sparta, WI (US)

(72) Inventors: Mathew A. McPherson, Norwalk, WI (US); Mark Hayes, Sparta, WI (US); Jeffrey A. Ozanne, Norwalk, WI (US); Tom Koshollek, Onalaska, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/153,549

(22) Filed: May 12, 2016

(65) Prior Publication Data

US 2016/0258709 A1 Sep. 8, 2016

Related U.S. Application Data

(63) Continuation of application No. 14/455,334, filed on Aug. 8, 2014, now Pat. No. 9,341,434.

(60) Provisional application No. 61/864,412, filed on Aug. 9, 2013, provisional application No. 61/913,862, filed on Dec. 9, 2013.

(51) Int. Cl.
*F41B 5/14* (2006.01)
*F41B 5/12* (2006.01)

(52) U.S. Cl.
CPC ..... *F41B 5/1469* (2013.01); *F41B 5/123* (2013.01)

(58) Field of Classification Search
CPC ..... F41B 5/123; F41B 5/1469
See application file for complete search history.

(56) References Cited

U.S. PATENT DOCUMENTS

| | | | | |
|---|---|---|---|---|
| 3,043,287 | A | 7/1962 | Nelson | |
| 3,670,711 | A | 6/1972 | Firestone | |
| 3,739,765 | A | 6/1973 | Moore | |
| 4,192,281 | A | 3/1980 | King | |
| 4,649,892 | A | 3/1987 | Bozek | |
| 4,662,345 | A | 5/1987 | Stephens | |
| 4,665,885 | A | 5/1987 | Glomski et al. | |
| 4,719,897 | A | 1/1988 | Gaudreau | |
| 4,721,092 | A | 1/1988 | Waiser | |
| 4,942,861 | A | 7/1990 | Bozek | |
| 5,115,795 | A | 5/1992 | Farris | |
| 5,205,267 | A | 4/1993 | Burdick | |
| 5,215,069 | A | 6/1993 | Liu | |
| 5,220,906 | A | 6/1993 | Choma | |
| 5,243,956 | A | 9/1993 | Luehring | |
| 5,437,260 | A | 8/1995 | King | |
| 5,553,596 | A | 9/1996 | Bednar | |
| 5,598,829 | A | 2/1997 | Bednar | |
| 5,649,520 | A | 7/1997 | Bednar | |
| 5,660,159 | A * | 8/1997 | Clayton | F41B 11/54 124/59 |

(Continued)

*Primary Examiner* — Jeffrey S Vanderveen

(57) ABSTRACT

In some embodiments, a crossbow crank comprises a housing and a shaft rotatable with respect to the housing. A one-way mechanism is arranged to prevent rotation of the shaft in a first rotational direction, but allow rotation in a second direction. A release mechanism is arranged to disengage the one-way mechanism from the shaft. The release mechanism has a first position and a second position, wherein the release mechanism moves along a length of the shaft between the first position and the second position.

15 Claims, 26 Drawing Sheets

(56) References Cited

U.S. PATENT DOCUMENTS

| | | | | |
|---|---|---|---|---|
| 5,678,528 | A | 10/1997 | Hadley | |
| 5,987,724 | A | 11/1999 | Kleman | |
| 6,095,128 | A | 8/2000 | Bednar | |
| 6,286,496 | B1 | 9/2001 | Bednar | |
| 6,799,566 | B1 | 10/2004 | Malucelli | |
| 6,874,491 | B2 | 4/2005 | Bednar | |
| 6,913,007 | B2 | 7/2005 | Bednar | |
| 7,100,590 | B2 | 9/2006 | Chang | |
| 7,784,453 | B1 * | 8/2010 | Yehle | F41B 5/12 124/25 |
| 8,375,928 | B1 * | 2/2013 | Bednar | F41B 5/1469 124/25 |
| 8,443,790 | B2 | 5/2013 | Pestrue | |
| 8,578,917 | B2 | 11/2013 | Bednar et al. | |
| 8,689,774 | B1 * | 4/2014 | Ritz | F41C 23/08 124/25 |
| 2010/0170486 | A1 * | 7/2010 | Shepley | F41A 11/02 124/25 |
| 2010/0170488 | A1 | 7/2010 | Rasor et al. | |
| 2012/0167710 | A1 * | 7/2012 | Giudici | B62H 5/10 74/594.4 |

* cited by examiner

CROSSBOW COCKING CRANK

CROSS-REFERENCE TO RELATED APPLICATIONS

This application claims the benefit and is a continuation of U.S. patent application Ser. No. 14/455,334, filed Aug. 8, 2014, which claims priority to and the benefit of U.S. Provisional Patent Application No. 61/864412, filed on Aug. 9, 2013, and U.S. Provisional Patent Application No. 61/913862, filed on Dec. 9, 2013, the entire disclosures of which are hereby incorporated herein by reference.

BACKGROUND OF THE INVENTION

This invention relates generally to crossbows and more specifically to crossbow cocking devices.

Crossbows are known in the art and generally comprise a bow portion and a stock with a latch. The latch retains the crossbow in a cocked position until operation of a trigger release the latch to fire the bow. Some examples of crossbows are disclosed in U.S. Pat. No. 6,095,128, US 2012-0298087, US 2014-0069401 and US 2014-0069404, the entire disclosures of which are hereby incorporated herein in their entireties.

Crossbows tend to have a relatively high draw weight, often ranging from 150-200 pounds or more. Such draw weights can require an assisting device to aid in crossbow cocking. One such device is a cocking rope, which uses leveraging to reduce the force that must be applied by the person cocking the crossbow. An example of a cocking rope device is disclosed in US 2014-0069403.

There remains a need for devices to aid in safe and reliable cocking of a crossbow.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a crossbow crank comprises a housing and a shaft rotatable with respect to the housing. A one-way mechanism is arranged to prevent rotation of the shaft in a first rotational direction, but allow rotation in a second direction. A release mechanism is arranged to disengage the one-way mechanism from the shaft. The release mechanism has a first position and a second position, wherein the release mechanism moves along a length of the shaft between the first position and the second position.

In some embodiments, the release mechanism is rotationally engaged with the shaft when in the first position and not rotationally engaged with the shaft when in the second position. In some embodiments, a biasing member is arranged to bias the release mechanism to its first position.

In some embodiments, the one-way mechanism comprises a roller clutch.

In some embodiments, the shaft comprises a first spool and a second spool oriented on opposite sides of the shaft.

In some embodiments, the crank comprises a crank arm engaged to the shaft. In some embodiments, the crank arm comprises a quick release mechanism and can be disengaged from the shaft.

In some embodiments, the release mechanism comprises a sleeve that surrounds the shaft. In some embodiments, the sleeve comprises a non-circular inner surface and the shaft comprises a non-circular portion arranged to engage the non-circular inner surface of the sleeve.

In some embodiments, the release mechanism comprises a release lever that extends through the housing. In some embodiments, the release lever is arranged to move laterally along a length of the shaft. In some embodiments, the release lever pivots with respect to the housing.

In some embodiments, the crank comprises a first shaft and a second shaft that is rotationally engaged to the first shaft. In some embodiments, a crank arm is attached to the first shaft. In some embodiments, a spool is attached to the second shaft. In some embodiments, the second shaft is arranged to rotate at a different speed from said first shaft. In some embodiments, the first shaft comprises a first gear, the second shaft comprises a second gear engaged with the first gear. In some embodiments, the first gear and the second gear each comprise a plurality of teeth, and the first and second gears have different numbers of teeth.

In some embodiments, a retraction spring is arranged to bias a shaft in a predetermined rotational direction.

In some embodiments, the housing comprises a guide slot and a cocking string passes through the guide slot.

In some embodiments, crossbow crank comprises a housing and a shaft rotatable with respect to the housing. A roller clutch mechanism is arranged to allow rotation of the shaft in one rotational direction and prevent rotation in a second direction. A release mechanism is arranged to disengage the roller clutch from the shaft.

These and other embodiments which characterize the invention are pointed out with particularity in the claims annexed hereto and forming a part hereof However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
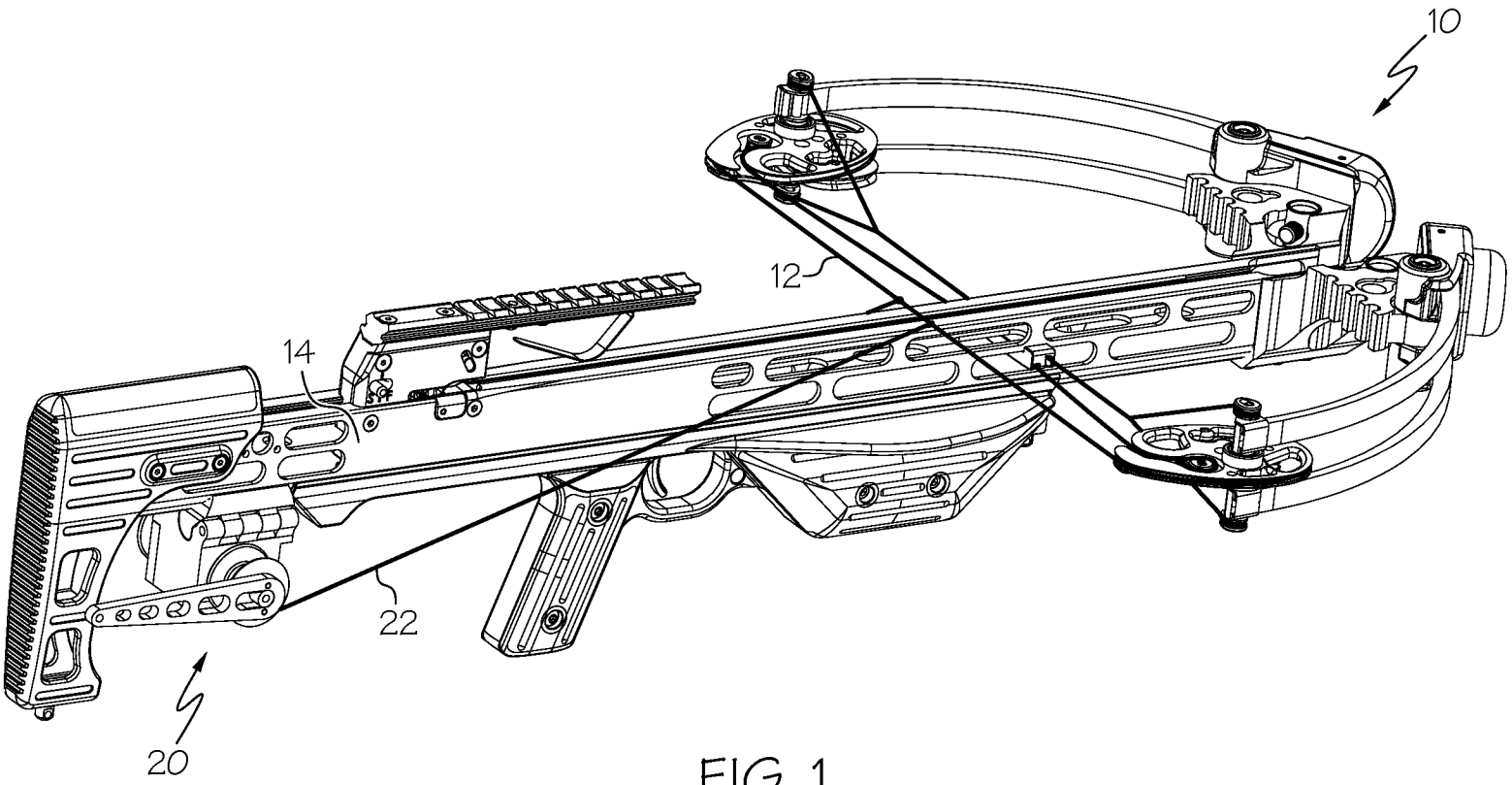
FIG. 1 shows an embodiment of a crossbow with a cocking crank.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a crossbow 10 having a bowstring 12 and an embodiment of a crossbow cocking crank 20.

Desirably, the cocking crank 20 engages or comprises a tension member 22 arranged to engage the bowstring 12. The tension member 22 can engage the bowstring 12 using any suitable method and in some embodiments comprises at least one hook. An example of hooks that can be used with a tension member 22 are disclosed in US 2014-0069403.

Operation of the cocking crank 20 to retract the tension member 22 desirably draws the bowstring 12. A tension member 22 can be any suitable tension member, such as a string, cable, strap, etc., and will be referred to herein as a string 22. Once the crossbow 10 is cocked (e.g. when the bowstring 12 is fully drawn and retained in the drawn orientation by a latch), the cocking string 22 is desirably disengaged from the bowstring 12.

In some embodiments, the cocking crank 20 is integral with a portion of the crossbow 10, such as being a portion of the stock 14. In some embodiments, the cocking crank 20 is fixedly attached to the crossbow 10 using any suitable method, such as fasteners such as screws. In some embodiments, the cocking crank 20 is arranged to be easily disengaged from the crossbow 10, for example comprising a quick release mechanism.

Figure 2:
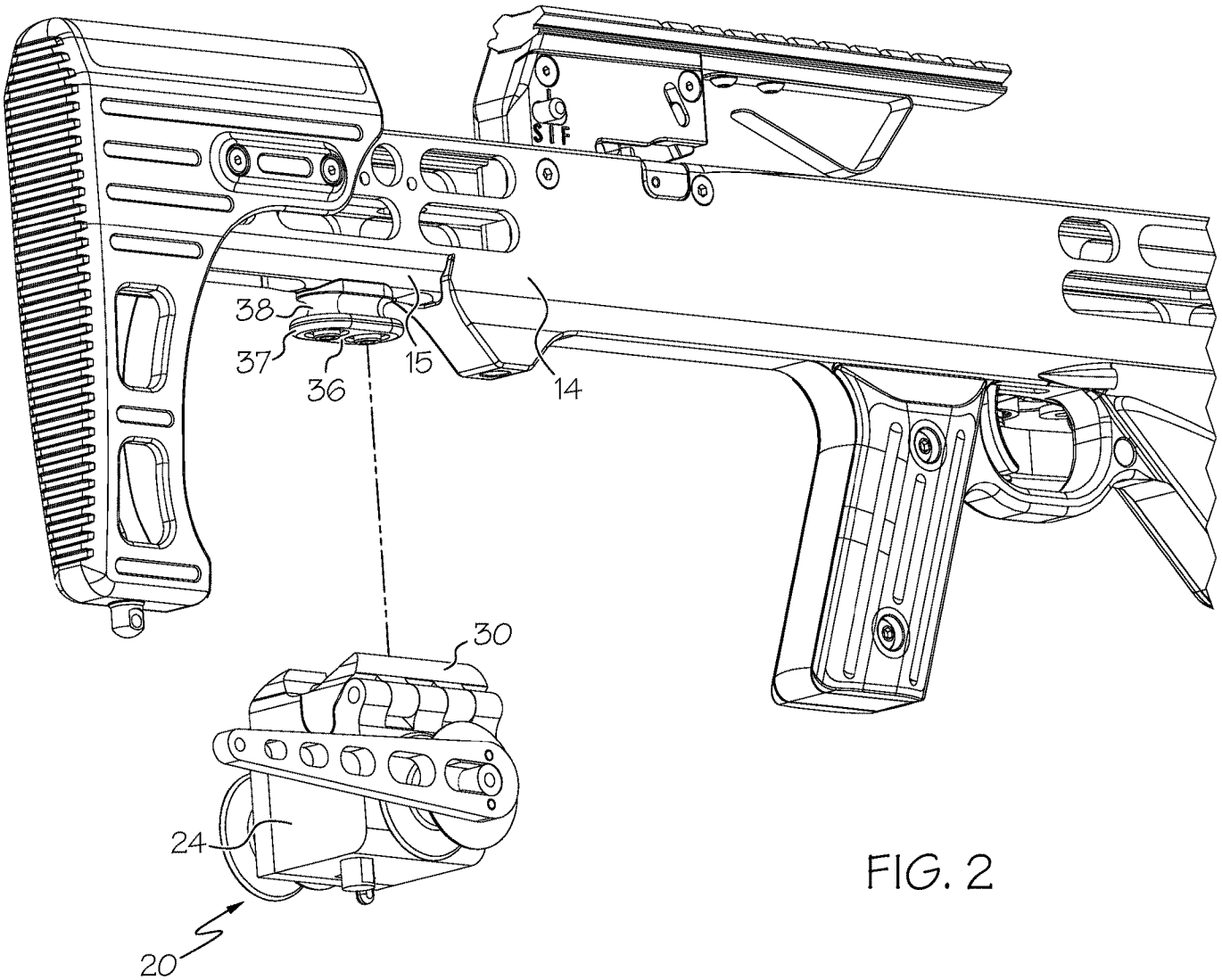
FIG. 2 shows an embodiment of a cocking crank detached from the crossbow.

FIG. 2 shows an embodiment of a cocking crank 20 detached from the crossbow 10. In some embodiments, the crossbow 10 comprises an anchor 36 that is constructed and arranged to receive and engage the cocking crank 20. In some embodiments, the crossbow 10 comprises an anchor as described in US 2014-006940. In some embodiments, an anchor 36 comprises a flange 37, which can extend around a portion or an entire periphery of the anchor 36. In some embodiments, an anchor 36 comprises a groove 38, which can extend around a portion or an entire periphery of the anchor 36. In some embodiments, an anchor 36 is integral with a portion of the crossbow 10. In some embodiments, an anchor 36 is attached to the crossbow 10, for example using fasteners such as screws.

Figure 3:
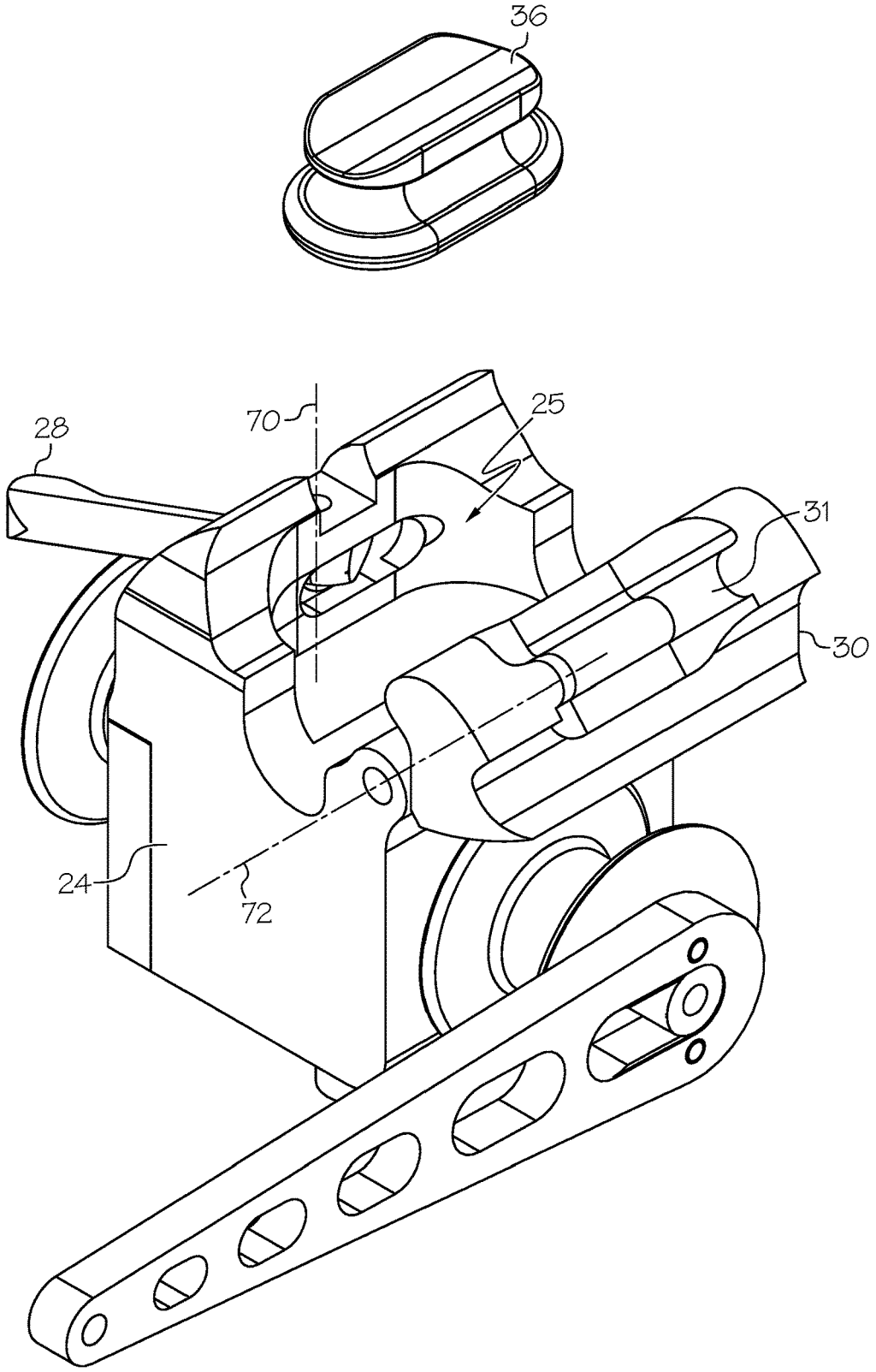
FIG. 3 shows an embodiment of a cocking crank arranged to engage an anchor.

FIG. 3 shows an embodiment of a cocking crank 20 and an embodiment of an anchor 36. In some embodiments, the cocking crank 20 comprises a housing 24 having an anchor cavity 25 that is arranged to receive an anchor 36. In some embodiments, the anchor cavity 25 and anchor 36 define complimentary shapes, which help to provide for a secure engagement. In some embodiments, the crank 20 comprises a release mechanism such as a locking bar 28. The locking bar 28 is desirably moveable with respect to the housing 24 between first and second positions. In some embodiments, the locking bar 28 is slidably or rotatably engaged to the housing 24. In some embodiments, the locking bar 28 is arranged to pivot about a locking mechanism pivot axis 70.

In some embodiments, the crank 20 comprises a wall member 30 that is moveable with respect to the housing 24 between first and second positions. Desirably, the wall member 30 comprises a surface 31 that defines at least a portion of the anchor cavity 25. In some embodiments, the surface 31 comprises a shape that is complimentary to the shape of the anchor 36. In some embodiments, the wall member 30 is slidably or rotatably engaged to the housing 24. In some embodiments, the wall member 30 is arranged to pivot about a wall member pivot axis 70. The wall member 30 can also be considered a second portion of the housing 24 that is moveable with respect to a main portion of the housing 24.

In some embodiments, the crank 20 comprises both a locking bar 28 and a moveable wall member 30, which can provide for a more secure engagement than either mechanism alone. In some embodiments, a locking bar 28 and a wall member 30 engage opposing portions of the anchor 36. The wall member pivot axis 70 can have any suitable orientation with respect to the locking mechanism pivot axis 70. In some embodiments, the wall member pivot axis 70 is orthogonal to the locking mechanism pivot axis 70.

Figure 4:
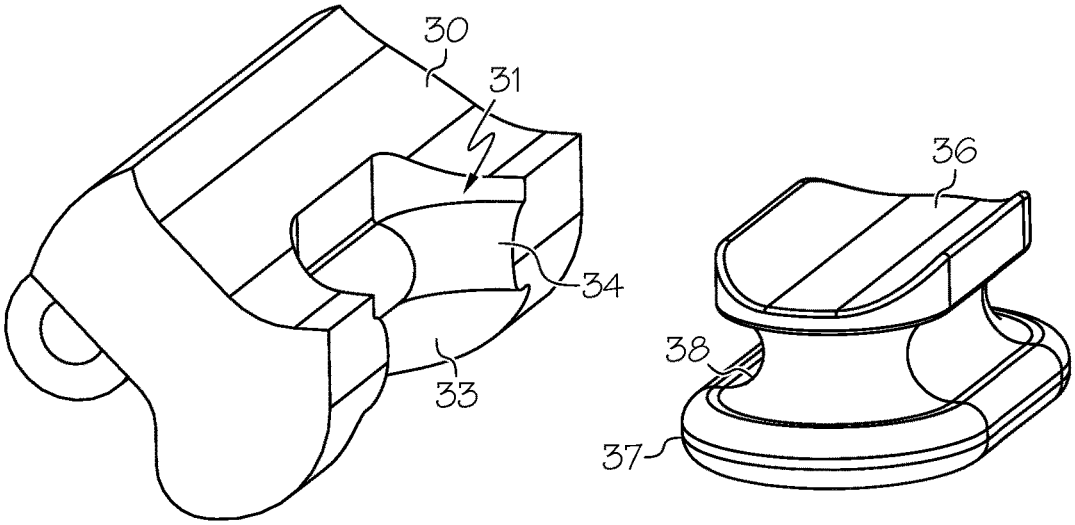
FIGS. 4 and 5 show an embodiment of an engagement mechanism.
Figure 5:
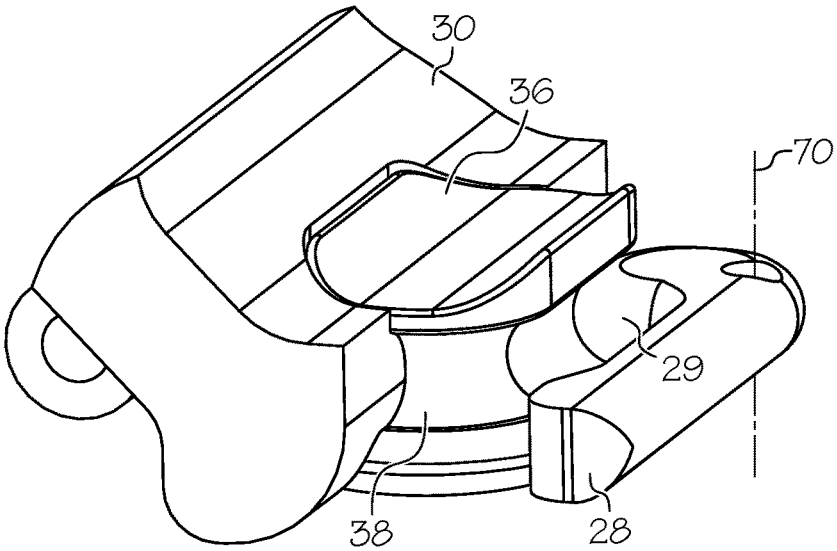

FIGS. 4 and 5 show an embodiment of the engaging mechanisms in greater detail. FIG. 4 shows an embodiment of a wall member 30 and an embodiment of an anchor 36. In some embodiments, a surface 31 of the wall member 30 is shaped to mate with a surface of the anchor 36. For example, the surface 31 can comprise a flange 34 arranged to engage a groove 38 in the anchor 36. In some embodiments, the flange 34 wraps around a portion of the anchor 36. As shown in FIG. 4, the wall member 30 and flange 34 engage approximately half of a periphery of the anchor 36, thereby engaging a front surface, a side surface, and a back surface of the anchor 36. In some embodiments, the engagement between the wall member 30 and the anchor 36 is sufficient to prevent movement of the crank 20 with respect to the crossbow 10, for example preventing movement along the drawing/shooting axis.

In some embodiments, the wall member 30 surface 31 comprises a recess 33 that receives a flange 37 of the anchor.

FIG. 5 shows the anchor 36 engaged with both a wall member 30 and a locking bar 28. In some embodiments, a locking bar 28 is moveable (e.g. about axis 70) between first (e.g. locked) and second (e.g. unlocked) positions. Desirably, the first position comprises an interference position wherein the anchor 36 is engaged with the locking bar 28, and the second position allows for release of the anchor 36. In some embodiments, the locking bar 28 comprises a cam lobe 29 that provides for the first/interference position. For example, as shown in FIG. 5, in a first position the cam lobe 29 is positioned in a portion of the groove 38 of the anchor 36.

Figure 6:
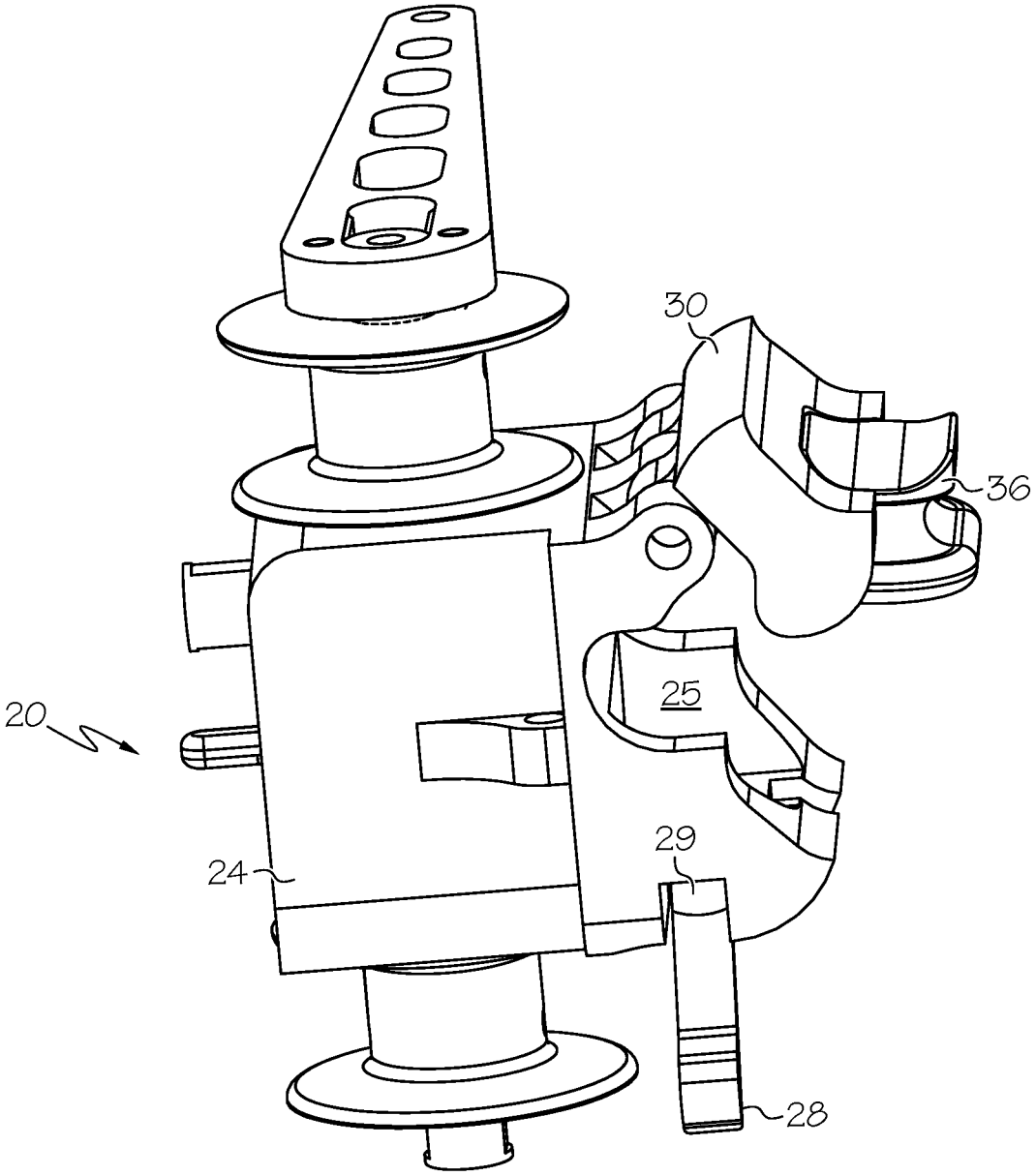
FIG. 6 shows an embodiment of a cocking crank in a process of being attached to an anchor.

FIG. 6 shows an embodiment of a crank 20 during a process of attaching the crank 20 to the anchor 36. The wall member 30 is oriented in a second position (e.g. open) and is engaged with the anchor 36. The wall member 30 will be moved into the first position (e.g. closed), wherein the anchor 36 will be received in the anchor cavity 25 of the housing 24. The locking bar 28 is in the second position (e.g. unlocked), wherein the locking bar 28 does not interfere with movement of the anchor 36.

Figure 7:
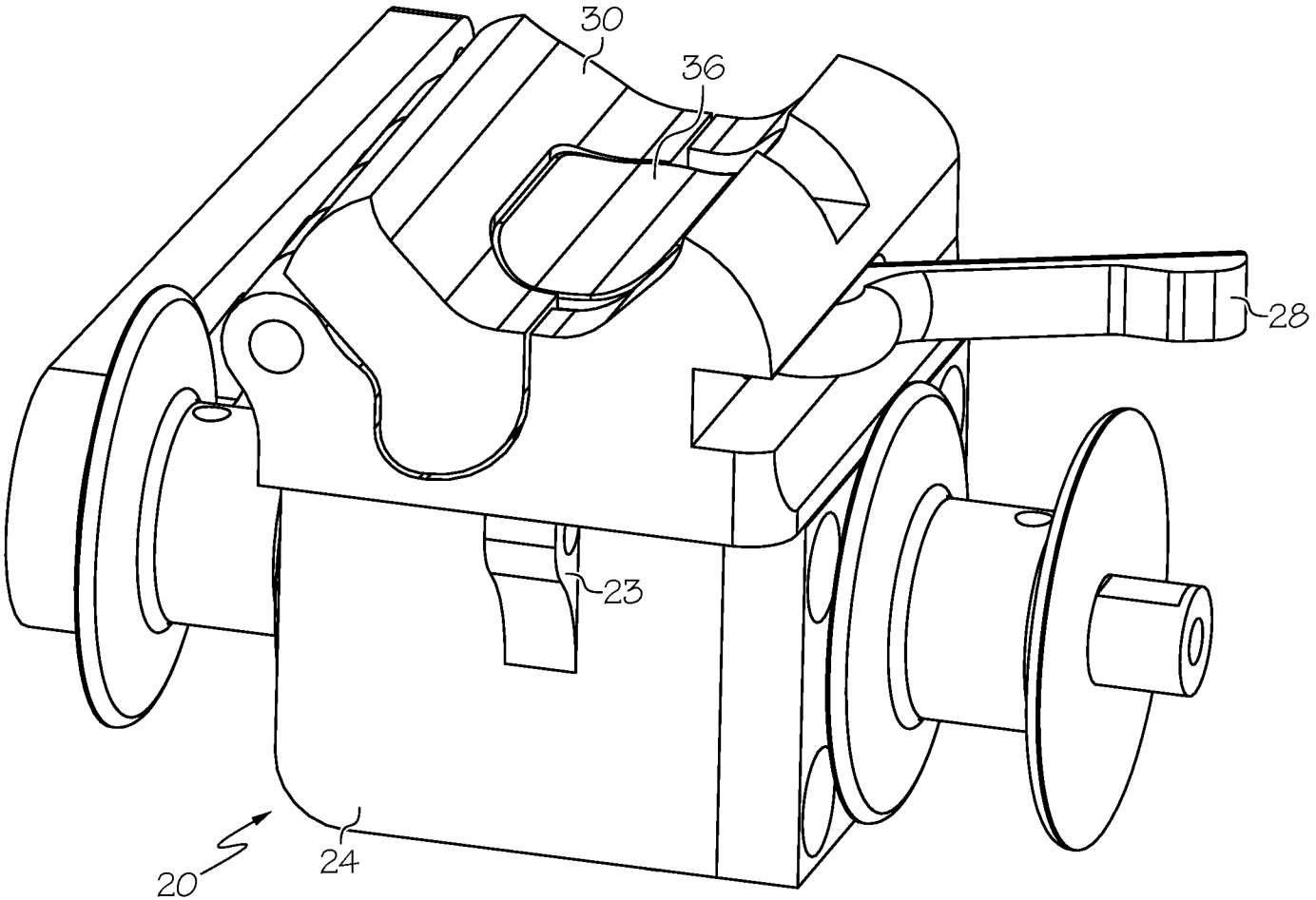
FIG. 7 shows an embodiment of a cocking crank in a process of being attached to an anchor.

FIG. 7 shows the crank 20 of FIG. 6 with the wall member 30 in the first position (e.g. closed). The locking bar 28 can be moved into its first position (e.g. locked) to fully engage the crank 20 to the anchor 36. In some embodiments, external surfaces of the housing 24 and wall member 30 near the anchor 36 are shaped complimentary to the crossbow 10. For example, upper surfaces of the housing 24 and wall member 30 shown in FIG. 7 are shaped complimentary to a portion 15 (see FIG. 2) of the crossbow stock 14 adjacent the anchor 36.

Figure 8:
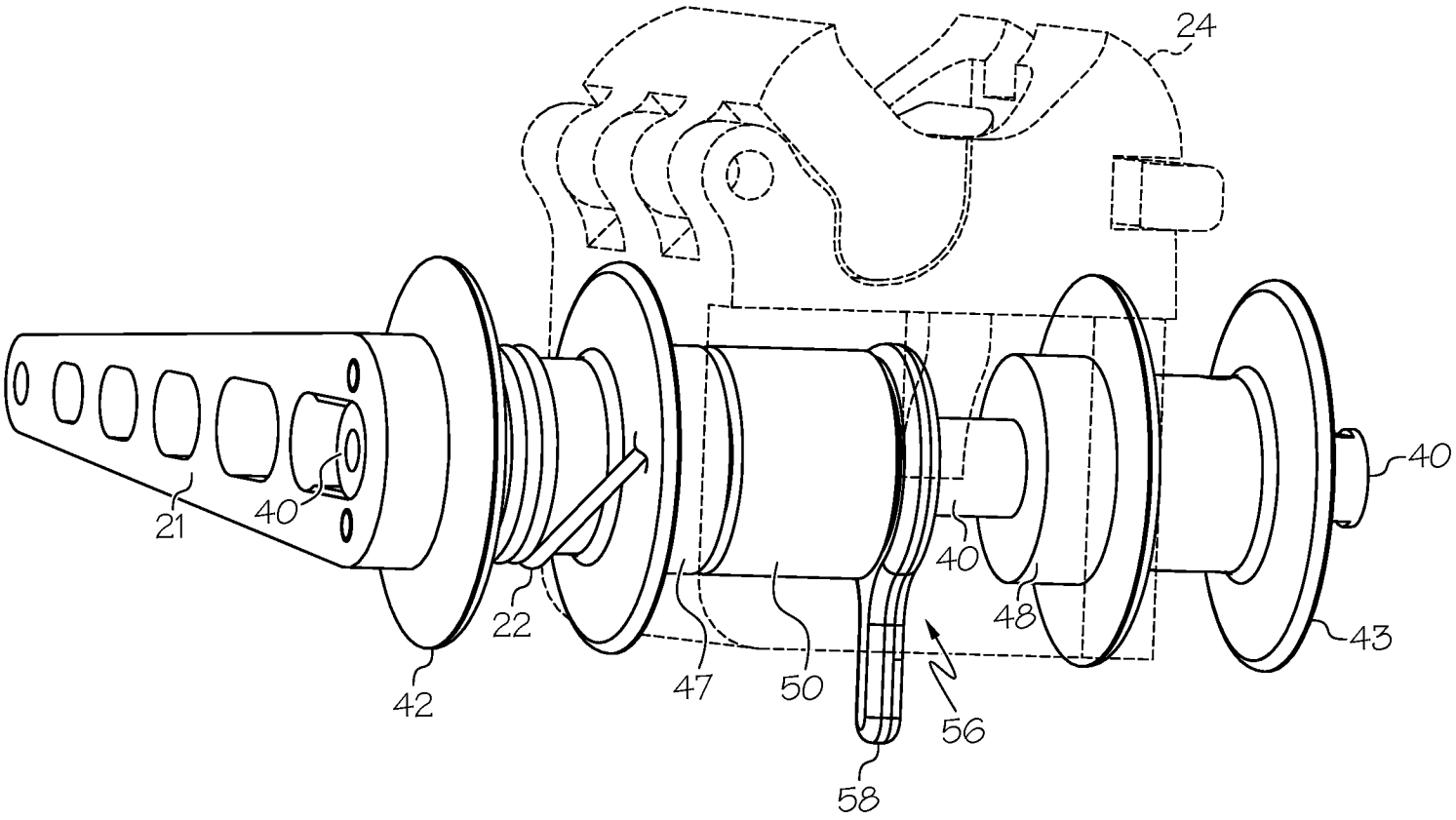
FIG. 8 shows an embodiment of a cocking crank with interior parts visible.

FIG. 8 shows an embodiment of a cocking crank 20, including some embodiments of internal components. The housing 24 is shown in hidden lines. Desirably, the crossbow crank 20 comprises a shaft 40, a crank arm 21 and a spool 42. The shaft 40 is received in the housing 24 and arranged to rotate with respect to the housing 24. For example, the shaft 40 can be journal mounted in the housing 24. In some embodiments, a cocking crank 20 comprises a bearing 47 between the housing 24 and the shaft 40, such as a sleeve bearing, a roller bearing, etc. FIG. 8 shows a first bearing 47 and a second bearing 48, each bearing 47, 48 provided at a location where the shaft 40 exits the housing 24.

In some embodiments, the shaft 40 extends through the housing 24 entirely and extends out from opposite sides of the housing 24. The crank arm 21 is attached to the shaft 40 and can be used to rotate the shaft 40. The spool 42 is also attached to the shaft 40 and rotates with the shaft 40. The cocking string 22 desirably winds around the spool 42 and extends, for example, toward the bowstring 12 (see FIG. 1).

It should be noted that a spool 42 is not necessary, as the cocking string 22 could be attached directly to the shaft 40 and wound upon the shaft; however, a spool 42 with sidewalls is desirable in that it will contain the cocking string 22.

The cocking string 22 can have any suitable configuration. In some embodiments, a single length of cocking string 22 extends to the bowstring 12, wherein a first end of the cocking string 22 engages the spool 42 or shaft 40, and a second end of the cocking string 22 engages the bowstring 12. In some embodiments, multiple lengths of cocking string 22 extend between the crank 20 and the bowstring 12. For example, in some embodiments, the crank 20 comprises a second spool 43 attached to the shaft 40 and a second, separate length of cocking string (not illustrated in FIG. 8). In some embodiments, the first spool 42 and the second spool 43 are located on opposite sides of the housing 24.

In some embodiments, the first spool 42 and the second spool 43 are mirrored on opposite sides of a firing axis or shooting plane. In some embodiments, various stretches of cocking string 22 are mirrored on opposite sides of the shooting plane. This arrangement helps to balance loads. In some embodiment, a single piece of cocking string 22 comprises a first stretch extending from the first spool 42 to the bowstring 12 and a second stretch extending from the second spool 43 to the bowstring 12.

Figure 29:
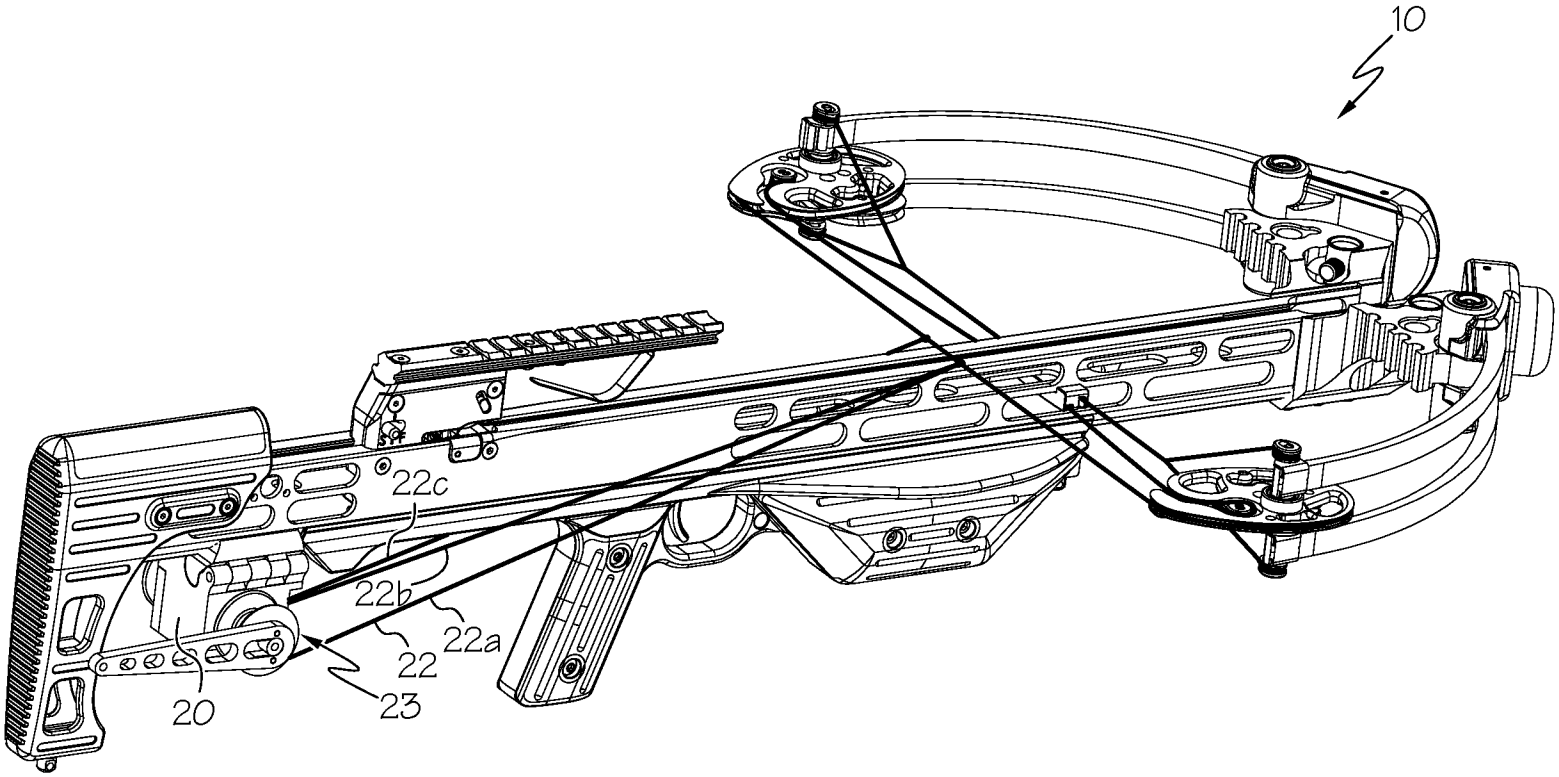
FIG. 29 shows an arrangement of a cocking string attached between the bowstring and crossbow crank.

In some embodiments, the crank 20 comprises a string anchor 23 (see e.g. FIGS. 7 and 29). In some embodiments, a string anchor 23 comprises an aperture or hook, for example formed in the housing 24, that allows force transfer between the cocking string 22 and the housing 24. In some embodiments, a cocking string 22 first portion 22*a* extends from a first spool 42 to the bowstring 12 and a second portion 22*b* extends back to the string anchor 23 of the crank 20. A third portion 22*c* extends back to the bowstring 12 and a fourth portion (not visible) extends to the second spool 43. In some embodiments, the crossbow 10 comprises an anchor that can be used in a manner similar to a housing anchor 23 as described herein.

In some embodiments, a portion of a cocking string 22 is oriented within the crossbow crank 20, for example passing through a portion of the shaft 40. In some embodiments, a cocking string 22 engages a bowstring 12 at one end, extends back to the first spool 42, passes through the shaft 40 to the second spool 43 and then engages the bowstring 12 at a second end.

In some embodiments, the crossbow crank 20 uses a bowstring engaging mechanism (not illustrated), for example as described in U.S. Pat. No. 6,095,128, the entire disclosure of which is hereby incorporated herein by reference. In some embodiments, a bowstring engaging mechanism comprises a body that provides for engagement between the bowstring 12 and cocking string 22.

FIG. 8 further shows a one-way mechanism 50 constructed and arranged to limit rotation of the shaft 40 to a single rotational direction. When the one-way mechanism 50 is engaged, desirably the shaft 40 will be prevented from rotating in a first direction and will be allowed to rotate in a second direction (e.g. opposite the first direction). Desirably, the bowstring 12 can be drawn as the shaft rotates in the second direction. A release mechanism 56 is desirably arranged to disengage the one-way mechanism 50 from the shaft 40.

In some embodiments, the one-way mechanism 50 and release mechanism 56 are contained within a cavity defined in the housing 24. As shown in FIG. 8, the bearings 47, 48 are also contained within the housing 24. In some embodiments, a release mechanism 56 comprises a release lever 58 that extends outside of the housing 24.

Figure 9:
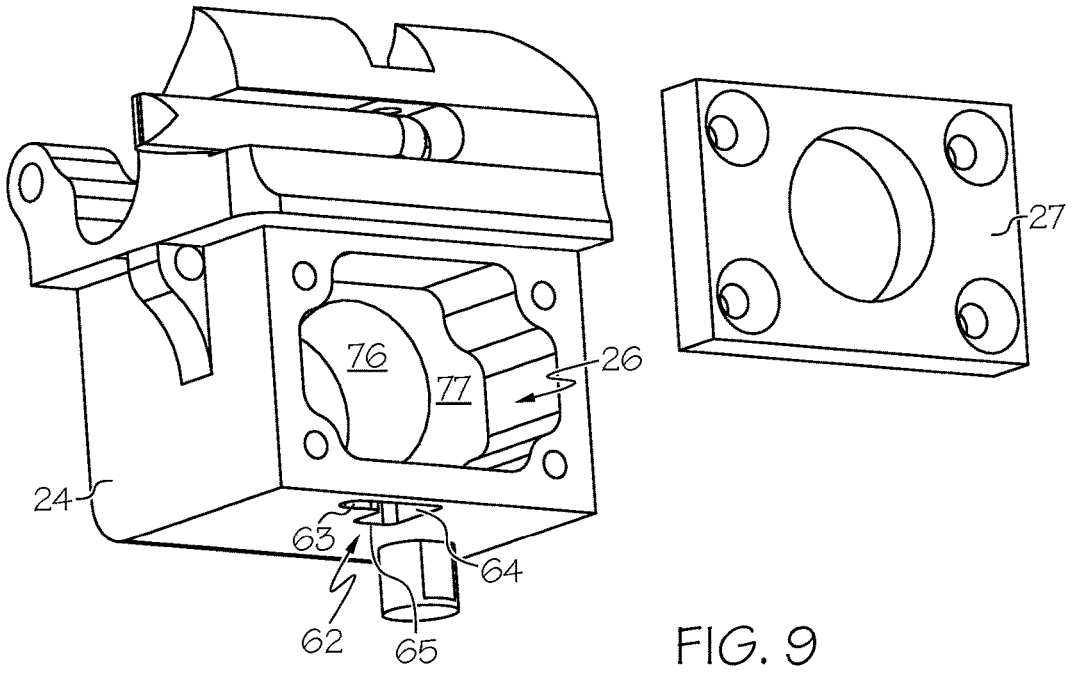
FIG. 9 shows an embodiment of a housing.
Figure 10:
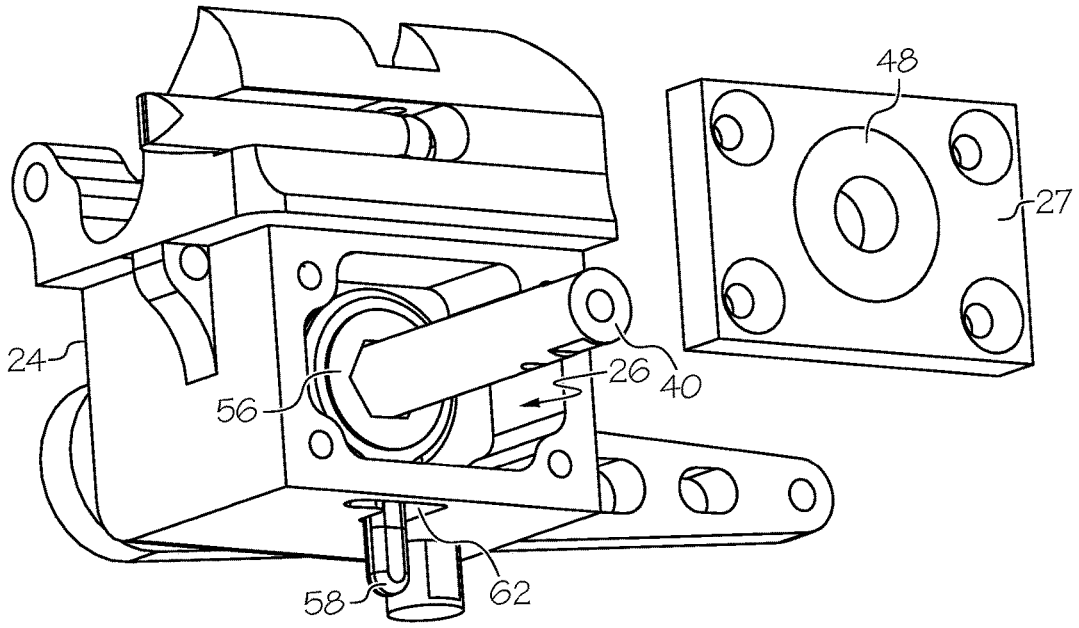
FIG. 10 shows the housing of FIG. 9 with some additional parts installed.

FIG. 9 shows an embodiment of a housing 24 in greater detail. FIG. 10 shows the housing of FIG. 9 with some additional components installed. In some embodiments, the housing 24 comprises an internal cavity 26. In some embodiments, the housing 24 comprises a cover 27 that is removable, which allows access to the internal cavity 27. In some embodiments, the cavity 27 comprises a first portion 76 and a second portion 77, which may have different sizes. In some embodiments, the first portion 76 is constructed and arranged to receive the one-way mechanism 50. In some embodiments, the one-way mechanism 50 is press-fit within the first portion 76 of the cavity 26 and is thus considered fixedly attached to the housing 24. The one-way mechanism 50 can also be attached via an adhesive, a fastener, or any other suitable method of attachment.

In some embodiments, the release mechanism 56, or at least a portion of the release mechanism 56, is oriented in the second portion 77 of the cavity 26. Desirably, the second portion 77 of the cavity 26 provides clearance for actuation of the release mechanism 56.

In some embodiments, the housing 24 comprises an aperture 62, and a release lever 58 extends through the aperture 62. In some embodiments, the aperture 62 comprises a first portion 63, a second portion 64. In some embodiments, the aperture 62 comprises an L-shape.

In some embodiments, the first portion 76 of the cavity 26 is arranged to receive the first bearing 47 (see FIG. 8). In some embodiments, the first bearing 47 is press-fit within the first portion 76 of the cavity 26. In some embodiments, both the first bearing 47 and the one-way mechanism 50 are mounted in the first portion 76 of the cavity 26. In some embodiments, the cover 27 is arranged to receive the second bearing 48. In some embodiments, the second bearing 48 is press-fit within the cover 27. The bearings 47, 48 can also be attached via an adhesive, a fastener, or any other suitable method of attachment.

Figure 11:
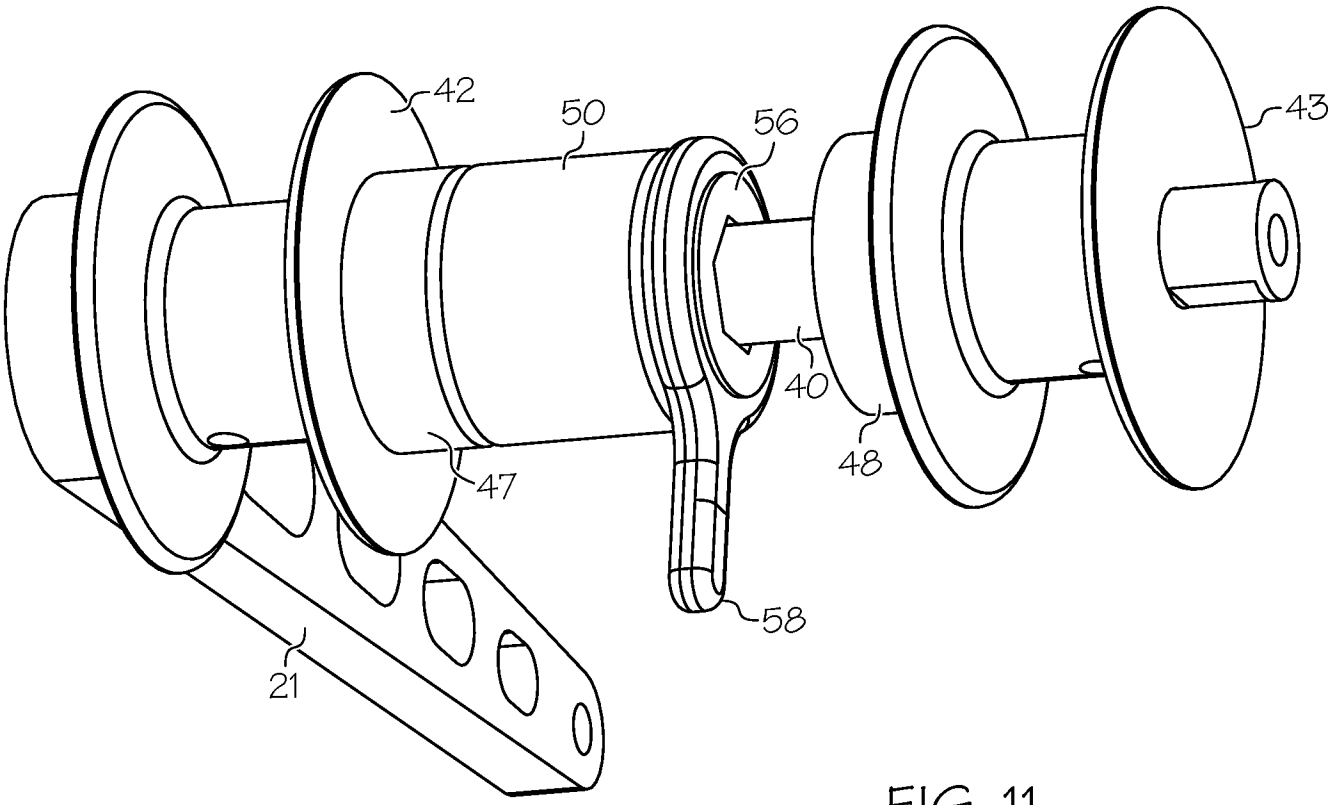
FIG. 11 shows portions of an embodiment of a crossbow crank.
Figure 12:
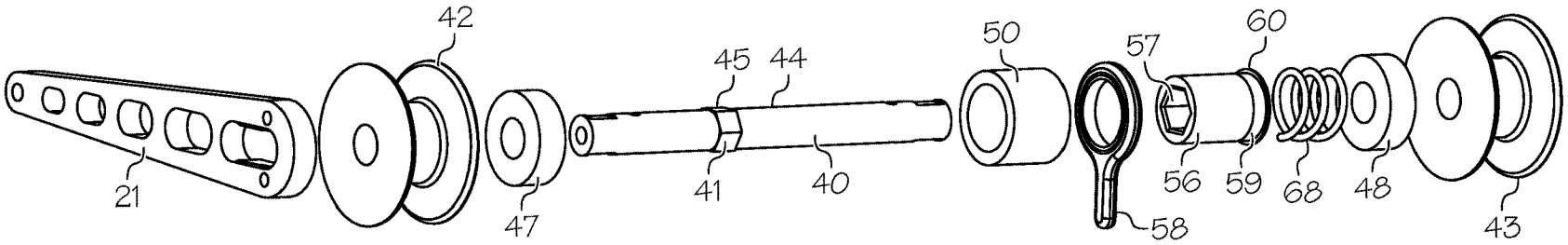
FIG. 12 shows an exploded view of FIG. 11.

FIG. 11 shows another view of parts of the embodiment shown in FIG. 8. FIG. 12 shows an exploded view of FIG. 11.

In some embodiments, the one-way mechanism 50 comprises a roller mechanism. In some embodiments, the one-way mechanism 50 does not comprise a ratcheting mechanism (e.g. does not include a pawl). In some embodiments, the one-way mechanism 50 comprises a one-way bearing. In some embodiments, the one-way mechanism 50 comprises a sprag clutch. Examples of sprag clutches are disclosed in U.S. Pat. No. 4,130,191 and are available from Renold Clutches & Couplings (Renold Ajax, 100 Bourne Street, Westfield, N.Y. 14787). In some embodiments, the one-way mechanism 50 comprises a roller clutch. Examples of roller clutches are disclosed in U.S. Pat. Nos. 3,625,324 and 3,731,774 and are available from INA Bearings (Schaeffler Technologies AG & Co. KG, Industriestraβe 1-3, 91074 Herzogenaurach, Germany). In some embodiments, the one-way mechanism 50 comprises an INA HFZ101410 roller clutch. Desirably, the one-way mechanism provides for near-silent operation and is generally more quiet than a ratcheting mechanism. A crossbow crank 20 that utilizes a roller clutch, sprag clutch or similar mechanism is generally more pleasurable to use than a ratcheting crank mechanism, for example due to reduced vibration and noise. Further, these one-way mechanisms can offer near instantaneous locking against movement.

Desirably, the one-way mechanism 50 provides engagement between the housing 24 and the shaft 40, allowing the shaft 40 to rotate with respect to the housing 24 in one direction but preventing rotation in the opposite direction.

In some embodiments, the one-way mechanism 50 can be engaged directly with the shaft 40. In some embodiments, the one-way mechanism 50 is engaged with the shaft 40 via a release mechanism 56.

In some embodiments, the release mechanism 56 comprises an intermediary member arranged between the shaft 40 and the one-way mechanism 50. In some embodiments, the release mechanism 56 comprises a sleeve. In some embodiments, at least a portion of the release mechanism 56 surrounds the shaft 40. In some embodiments, at least a portion of the release mechanism 56 is oriented within the one-way mechanism 50. In some embodiments, a release lever 58 extends from the release mechanism 56. In some embodiments, the release lever 58 comprises an aperture and the release mechanism 56 comprises a groove 59 arranged to receive the aperture. Desirably, the release lever 58 is rotatable with respect to the sleeve, allowing the sleeve to rotate with the shaft 40 while the release lever 58 remains stationary. In some embodiments, the release mechanism 56 comprises a flange 60 arranged to abut a portion of the release lever 58. In some embodiments, a biasing member 68 is arranged to bias the release mechanism 56 in a particular direction.

Figure 13:
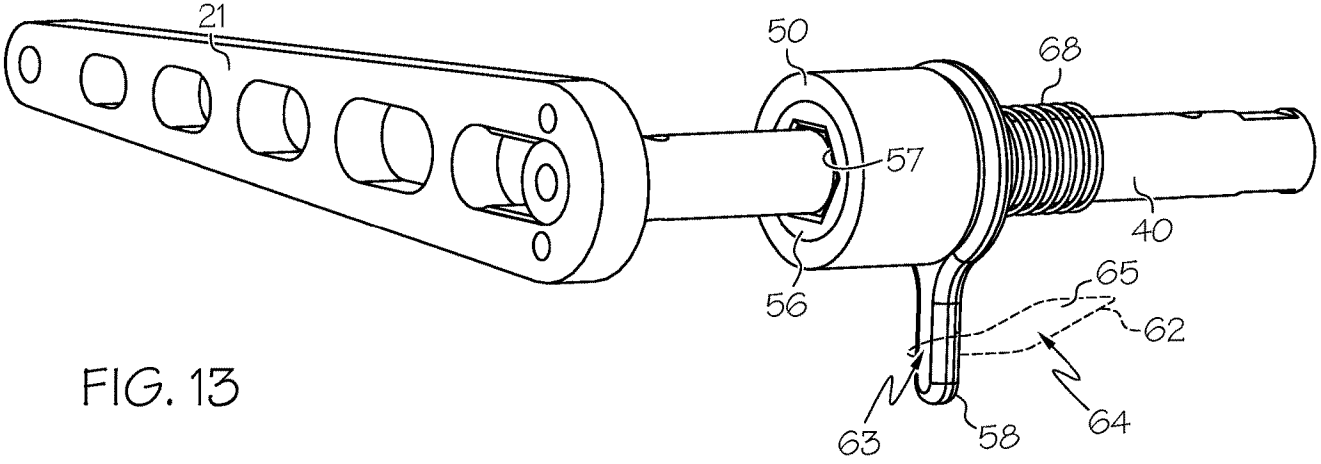
FIG. 13 shows an embodiment of portions of a crossbow crank detailing an embodiment of a release mechanism in a first position.
Figure 14:
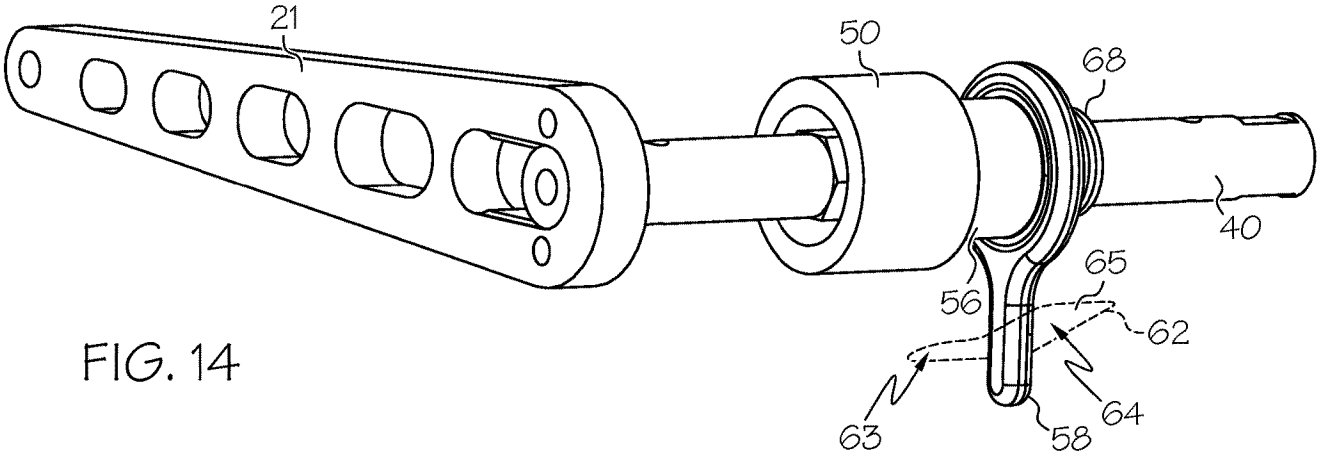
FIG. 14 shows an embodiment of a release mechanism in a second position.
Figure 15:
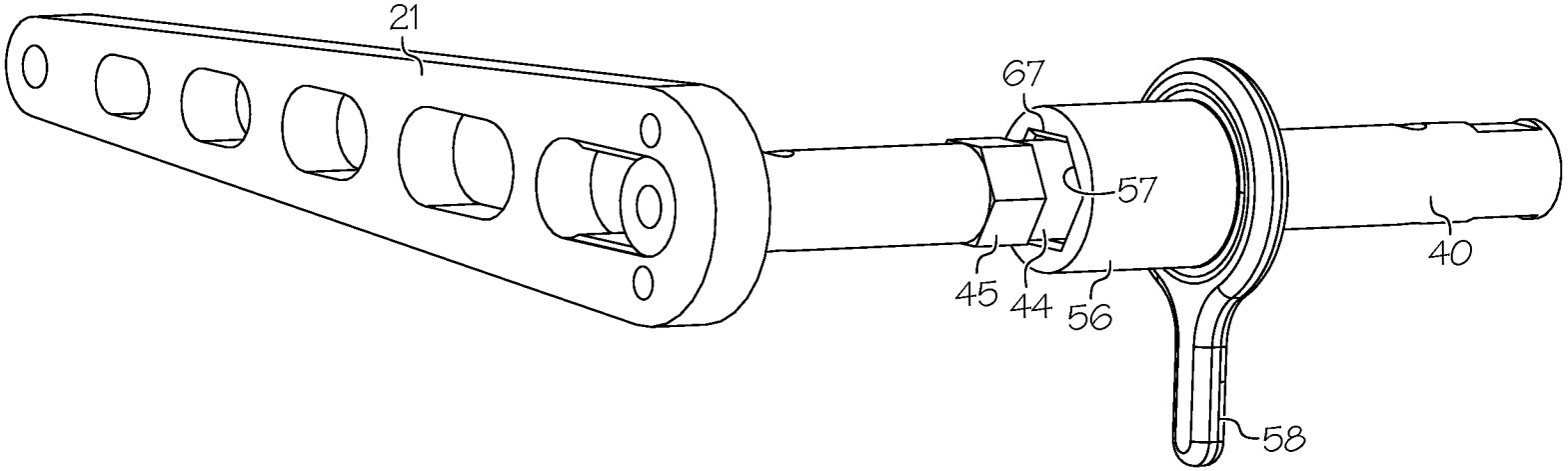
FIG. 15 shows the embodiment of FIG. 14 in better detail.

FIGS. 13-15 show an embodiment of a release mechanism 56 in operation. FIG. 13 shows a first orientation, wherein the release mechanism 56 is rotationally engaged to the shaft 40. FIGS. 14 and 15 show a second orientation, wherein the release mechanism 56 is disengaged rotationally from the shaft 40. FIG. 15 is similar to FIG. 14 but omits the one way mechanism 50 so the interaction between the shaft 40 and release mechanism 56 is more visible.

With reference to FIGS. 12-15, in some embodiments, the shaft 40 comprises a first portion 44 and an adjacent second portion 45. The first portion 44 comprises a first shape (e.g. cross-sectional shape or external perimeter shape) and the second portion 45 comprises a second shape different from the first shape. Desirably, the second portion 45 is shaped to engage the release mechanism 56, whereas the first portion 44 is arranged to not engage the release mechanism 56. In some embodiments, the first portion 44 comprises a circular shape. In some embodiments, the second portion 45 comprises a non-circular shape. In some embodiments, the second portion 45 comprises a plurality of flat surfaces 41. In some embodiments, the second portion 45 defines a hexagonal shape.

Desirably, the release mechanism 56 is configured to engage the second portion 45 of the shaft 40, and to not engage the first portion 44. For example, in some embodiments, the release mechanism 56 comprises a cavity 57 arranged to receive the shaft 40, and a cross-sectional shape of at least a portion of the cavity 57 is similar to a cross-sectional shape of the shaft second portion 45. As shown in FIGS. 12-15, the cavity 57 and the shaft 40 second portion 45 comprises complimentary hexagonal shapes. The cavity 57 and second portion 45 can have any suitable shape that provides for rotational engagement therebetween. The first portion 44 of the shaft 40 can have any suitable shape that does not engage the release mechanism 56, and can simply be smaller than the release mechanism 56.

Desirably, the release mechanism 56 is moveable between first and second positions, wherein the first position provides for rotational engagement between release mechanism 56 and the shaft 40, thereby providing for rotational engagement between the one-way mechanism 50 and the shaft 40. The second position disengages the release mechanism 56 from the shaft 40, thereby providing for disengagement of the shaft 40 from the one-way mechanism 50. In some embodiments, a biasing member 68, such as a spring, is provided to bias the release mechanism 56 toward its first (e.g. engaged) position.

In some embodiments, the release mechanism 56 is moveable with respect to the shaft 40 in a shaft axial (e.g. lengthwise) direction. For example, the release mechanism 56 is moveable along the length of the shaft 40 between a first position (e.g. as shown in FIG. 13) and a second position (e.g. as shown in FIGS. 14 and 15). In the embodiment illustrated in FIGS. 12-15, the one-way mechanism 50 can be considered fixed to the housing 24 (see e.g. FIG. 8) and the release mechanism 56 can be considered to be always rotationally engaged to the one-way mechanism 50. When the release mechanism 56 is in the first position, the shaped portion of the internal cavity 57 of the release mechanism 56 is aligned with the second portion 45 of the shaft 40, and the release mechanism 56 is rotationally engaged with the shaft 40. When the release mechanism 56 is moved to the second position (e.g. by moving along the length of the shaft 40), the shaped/engaging portion of the internal cavity 57 of the release mechanism 56 is moved off of the second portion 45 and becomes oriented over the first portion 44 of the shaft 40, wherein the release mechanism 50 is disengaged from the shaft 40. When the release mechanism 56 is in the second position, rotation of the shaft 40 is not limited by the one-way mechanism 50.

In some embodiments, an opening of the internal cavity 57 of the release mechanism 56 comprises a flare 67 or an increase in size. This helps the release mechanism 56 return to its first (e.g. engaged) position.

FIGS. 13 and 14 also show an embodiment of an aperture 62 formed in the housing 24. The housing 24 and aperture 62 are more clearly illustrated in FIG. 9. FIGS. 13 and 14 show how the positioning of the release lever 58 relates to the various portions of the aperture 62 in some embodiments of a crossbow crank 20. Desirably, the aperture 62 comprises at least a first portion 63 and a second portion 64. When the release mechanism 56 is in a first axial position (e.g. as shown in FIG. 13, engaged to the shaft 40), the release lever 58 is oriented in the first portion 63 of the aperture 62. When the release mechanism 56 is in the second axial position (e.g. as shown in FIG. 14, not engaged to the shaft 40), the release lever 58 is oriented in the second portion 64 of the aperture 62.

In some embodiments, the release mechanism 56 can be locked in the disengaged orientation (e.g. second axial position), thereby preventing engagement between the shaft 40 and the one-way mechanism 50. In some embodiments, the aperture 62 comprises a third portion 65, and orientation of the release lever 58 in the third portion 65 locks the release mechanism 56 and prevents the release mechanism 58 from returning to its first axial/engaged position. As shown in FIG. 14, the third portion 65 of the aperture 62 is arranged such that the release lever 58 can be rotated into the third portion 65 while the release mechanism 56 is in the second axial/unlocked position. When the release lever 58 is oriented in the third portion 65 of the aperture 62, the housing 24 abuts the release lever 58 and prevents the release mechanism 56 from moving along the length of the shaft 40.

Figure 16:
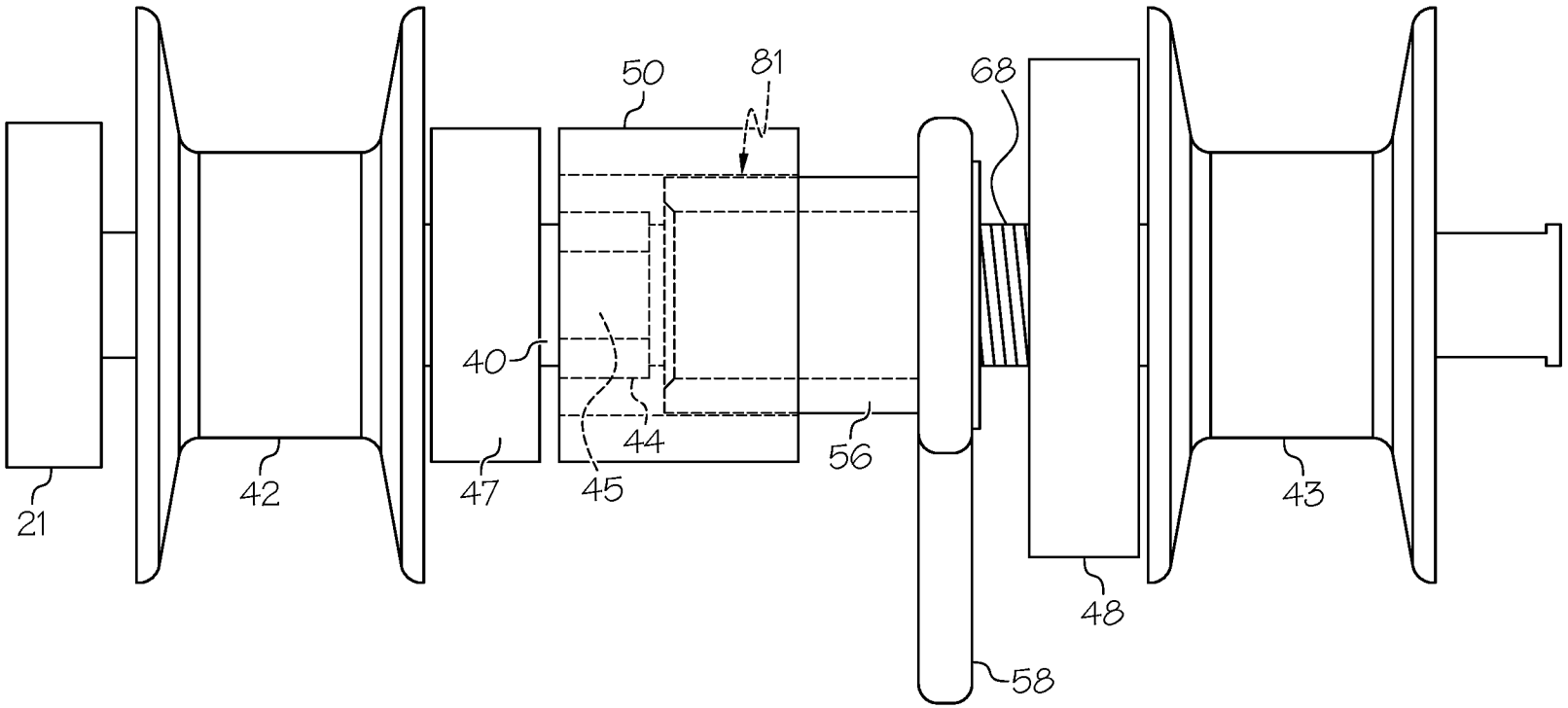
FIG. 16 shows portions of an embodiment of a crossbow crank.

FIG. 16 shows an end view of portions of an embodiment of a crossbow crank 20 to illustrate movement of the release mechanism 56. The release mechanism 56 is shown in the second (e.g. disengaged) axial position, wherein the release mechanism 56 is not engaged with the second portion 45 of the shaft 40. The biasing member 68 is compressed. It can be noted that the one-way mechanism 50 is still engaged rotationally to the release mechanism 56 (e.g. along interface 81).

Figure 17:
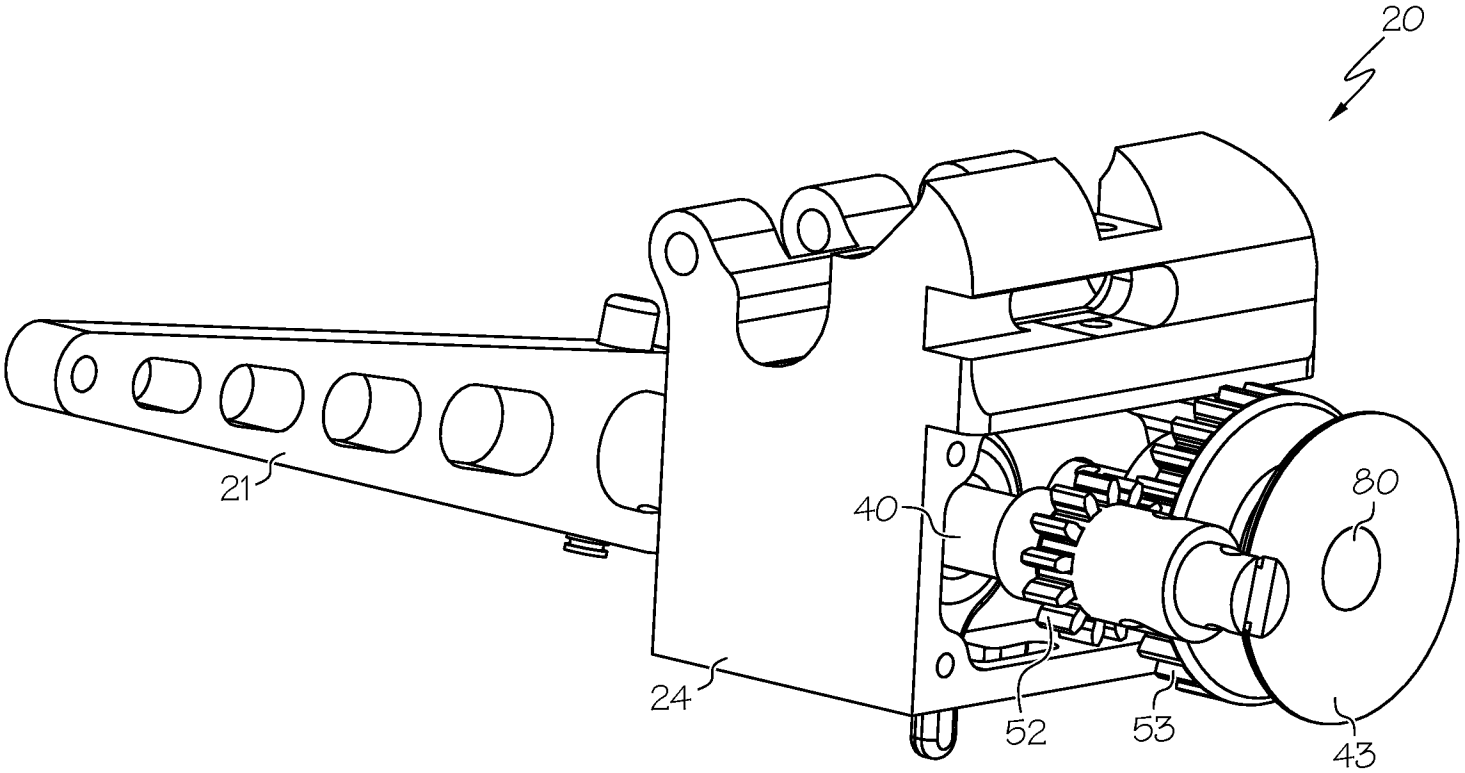
FIGS. 17 and 18 each show views of another embodiment of a crossbow crank.
Figure 18:
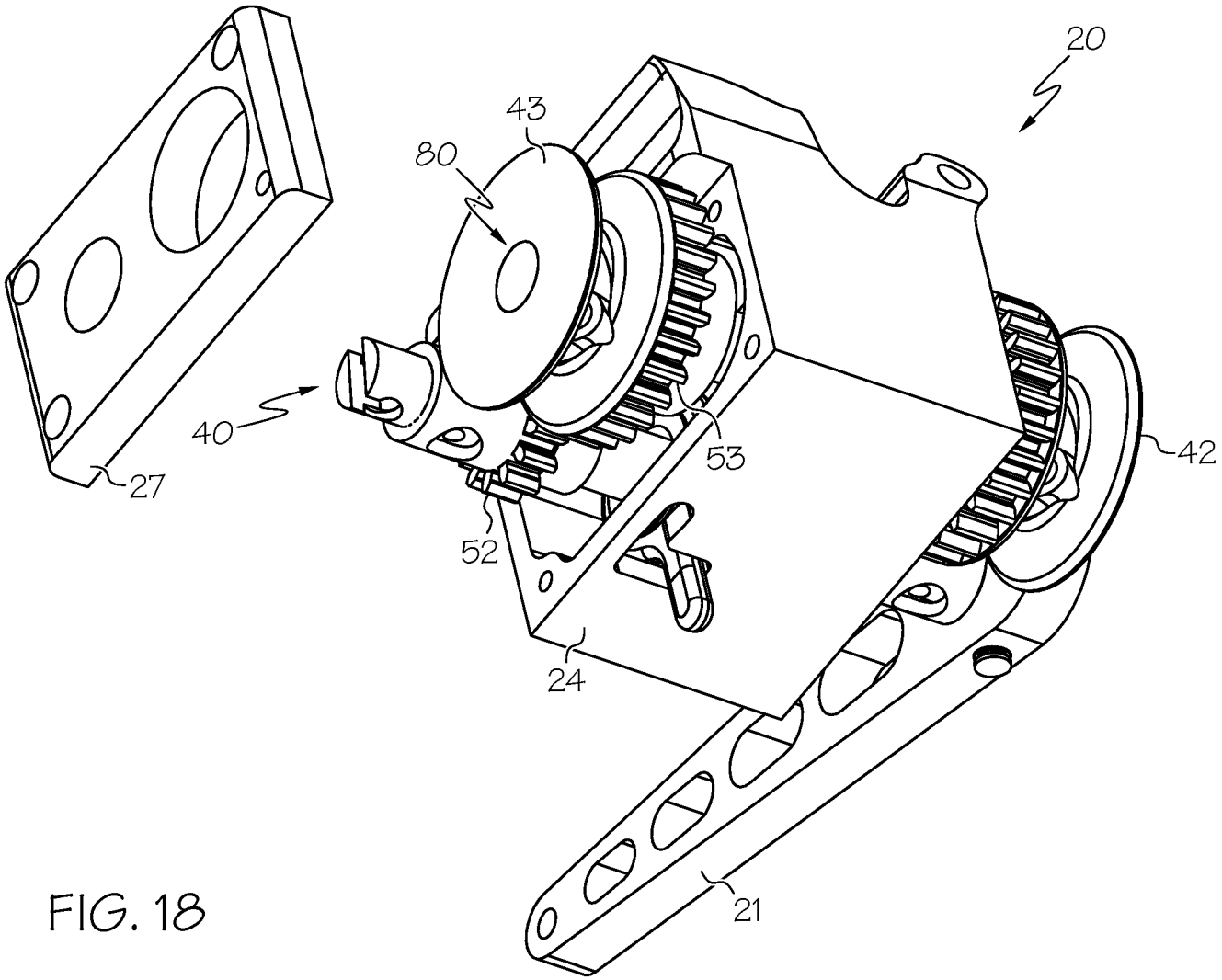

FIGS. 17 and 18 each show another embodiment of a crossbow crank 20. A cover 27 of the housing 24 has been omitted from FIG. 17 to show more detail, and the cover 27 is shown in FIG. 18 detached from the housing 24.

In some embodiments, a crossbow crank 20 comprises a first shaft 40 and a second shaft 80. In some embodiments, the first shaft 40 is oriented parallel to the second shaft 80. In some embodiments, one or both of the shafts 40, 80 extend outside of the housing 24, and the housing 24 can include apertures for the shafts 40, 80.

In some embodiments, the first shaft 40 is engaged to the second shaft 80 such that rotation of the first shaft 40 will cause rotation of the second shaft. The first shaft 40 and second shaft 80 can be engaged to one another using any suitable method, such as frictional engagement, a drive belt, gearing, etc. As shown in FIGS. 17 and 18, the shafts 40, 80 each comprise respective gears 52, 53 arranged to mesh with one another.

In some embodiments, one of the shafts 40, 80 is arranged to be rotated by application of a rotational force, and the other of the shafts 40, 80 is arranged to spool a cocking string (e.g. 22 in FIG. 1). As shown in FIGS. 17 and 18, a crank arm 21 is engaged to the first shaft 40 and the second shaft 80 comprises spools 42, 43. Thus, the first shaft 40 can be rotated by turning the crank arm 21, which causes rotation of the second shaft 80, thereby turning the spools 42, 43.

In some embodiments, the engagement between the first shaft 40 and the second shaft 80 can create a mechanical advantage by having the shafts 40, 80 turn at different speeds. For example, shafts 40, 80 that are engaged by friction or a belt can comprise different diameters. As shown in FIGS. 17 and 18, the shafts 40, 80 comprise gears 52, 53 of different sizes. For example, the gear 52 of the first shaft 40 comprises less teeth than the gear 53 of the second shaft 80, which causes a reduction in turning speed and increase in torque. In practice, this ratio between the shafts 40, 80 will reduce the turning effort that must be applied to the crank arm 21 to cock a crossbow. In some embodiments, the ratio can be reversed, wherein the second shaft 80 would rotate faster than the first shaft 40.

The use of two shafts 40, 80 can also reverse the direction of cranking required to be applied by the user when compared to a single shaft embodiment.

Figure 19:
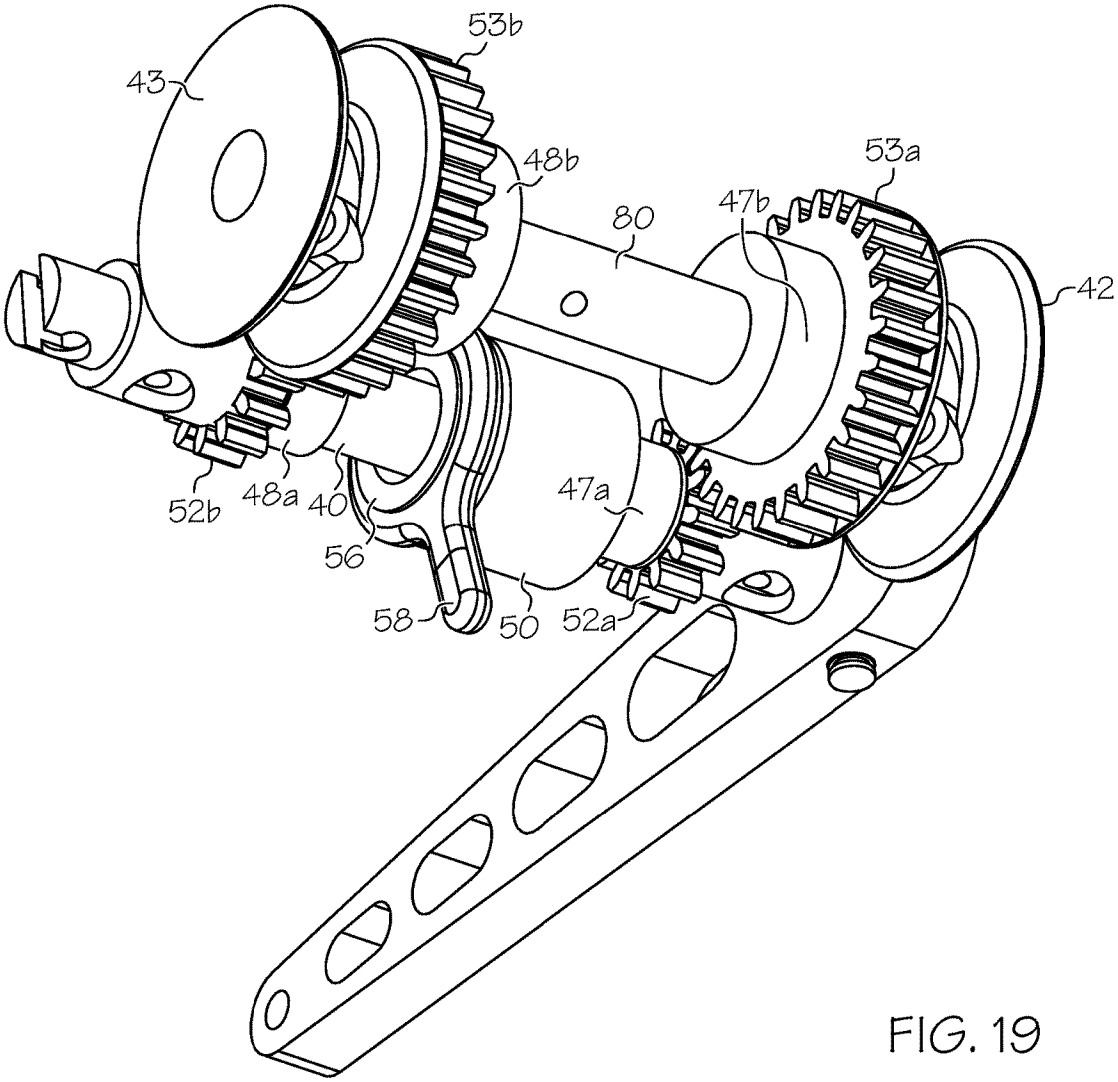
FIGS. 19 and 20 each show portions of the embodiment of a crossbow crank shown in FIGS. 17 and 18.
Figure 20:
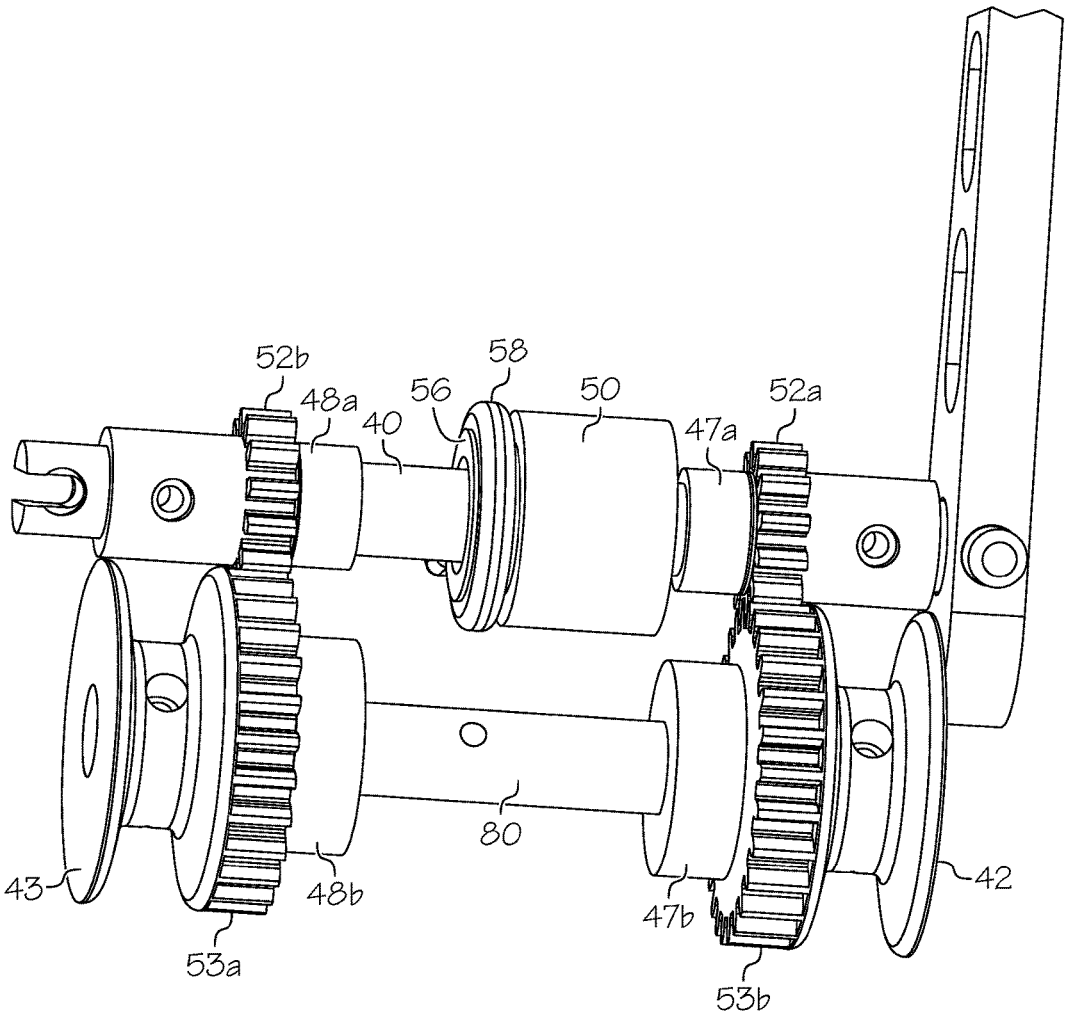

FIGS. 19 and 20 show portions of the crossbow crank 20 embodiment illustrated in FIGS. 17 and 18 but omit the housing. The viewing angle of FIG. 19 is similar to that of FIG. 18.

In some embodiments, the one-way mechanism 50, release mechanism 56 and release lever 58 are engaged to the first shaft 40, as shown in FIGS. 19 and 20. In some embodiments, these components can be engaged to the second shaft 80. A crank arm 21 can also be engaged to either shaft 40, 80.

In some embodiments, the first shaft 40 and second shaft 80 can be engaged to one another at multiple locations. In some embodiments, the first shaft 40 comprises a first gear 52*a* and a second gear 52*b*, and the second shaft 80 comprises a first gear 53*a* and a second gear 53*b*, engaged as illustrated in FIGS. 19 and 20. In some embodiments, the pair of meshing gears are balanced on opposing sides of the shafts 40, 80.

In some embodiments, the gears 52, 53 are oriented outside of the housing 24. In some embodiments, gears 52, 53 can be hidden within the housing.

Each shaft 40, 80 can further have bearings 47*a*, 47*b*, 48*a*, 48*b* provided at locations where the shaft 40, 80 extends though the housing 24.

In some embodiments, the crossbow crank 20 comprises a motor or similar mechanism arranged to rotate the shaft 40. For example, an electric motor can be supplied as an alternative or supplement to the crank arm 21.

Figure 21:
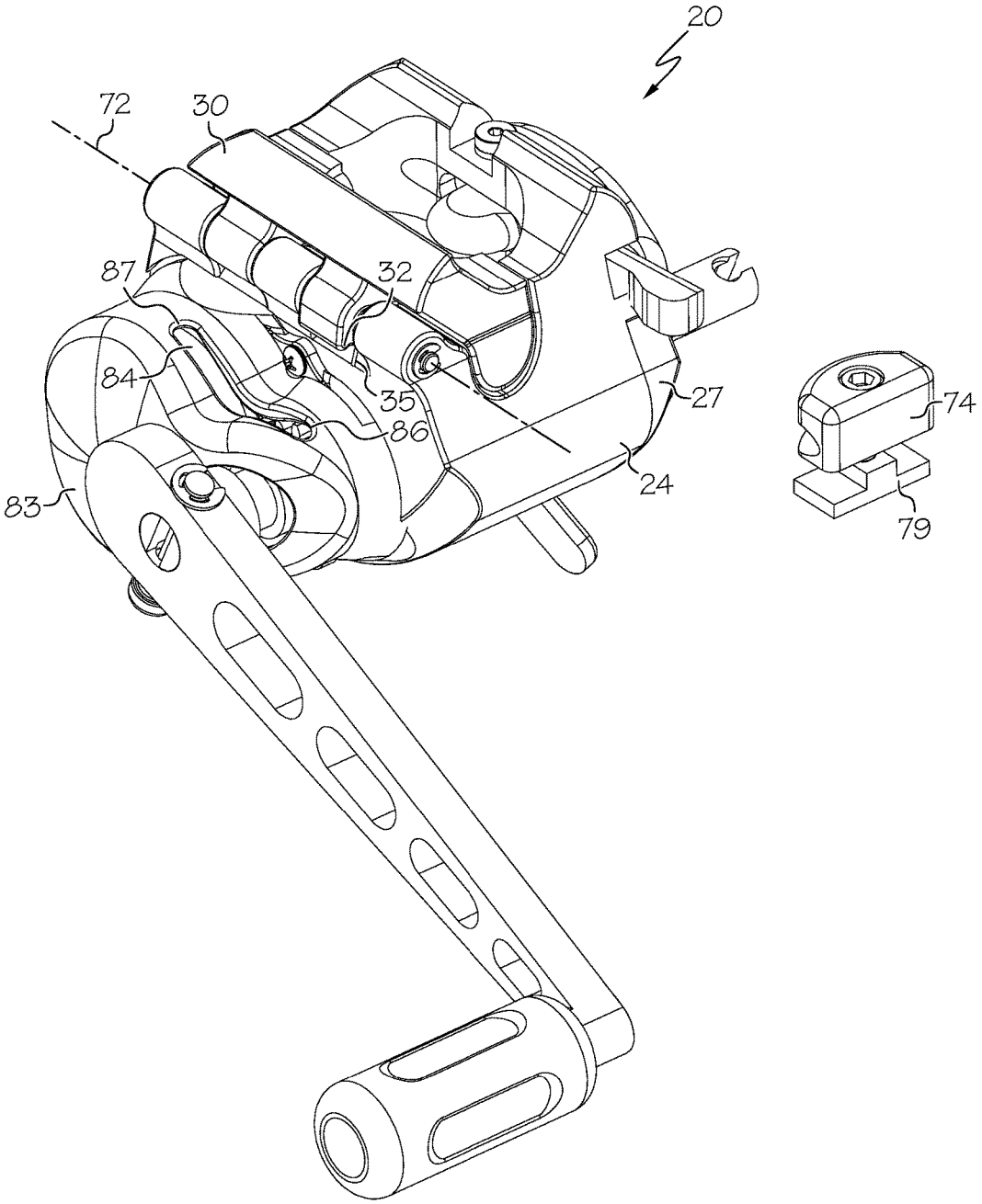
FIGS. 21-23 show another embodiment of a crossbow crank.

FIG. 21 shows another embodiment of a crossbow crank 20, having a housing 24 and cover 27 more contoured than previously shown herein. The crank 20 further includes side covers 83 on either side of the housing 24.

In some embodiments, a string centering device 74 is provided along with a crossbow crank 20. Desirably, the string centering device 74 is attachable to a crossbow 10. For example, the string centering device 74 can be attached to the stock 14, for example in a target area 75 located behind the string catch and sight mount (see FIG. 1). In some embodiments, a mounting bracket 79 is provided. As shown in FIG. 21, the mounting bracket 79 comprises a central ridge that can occupy a gap in the stock 14.

Figure 22:
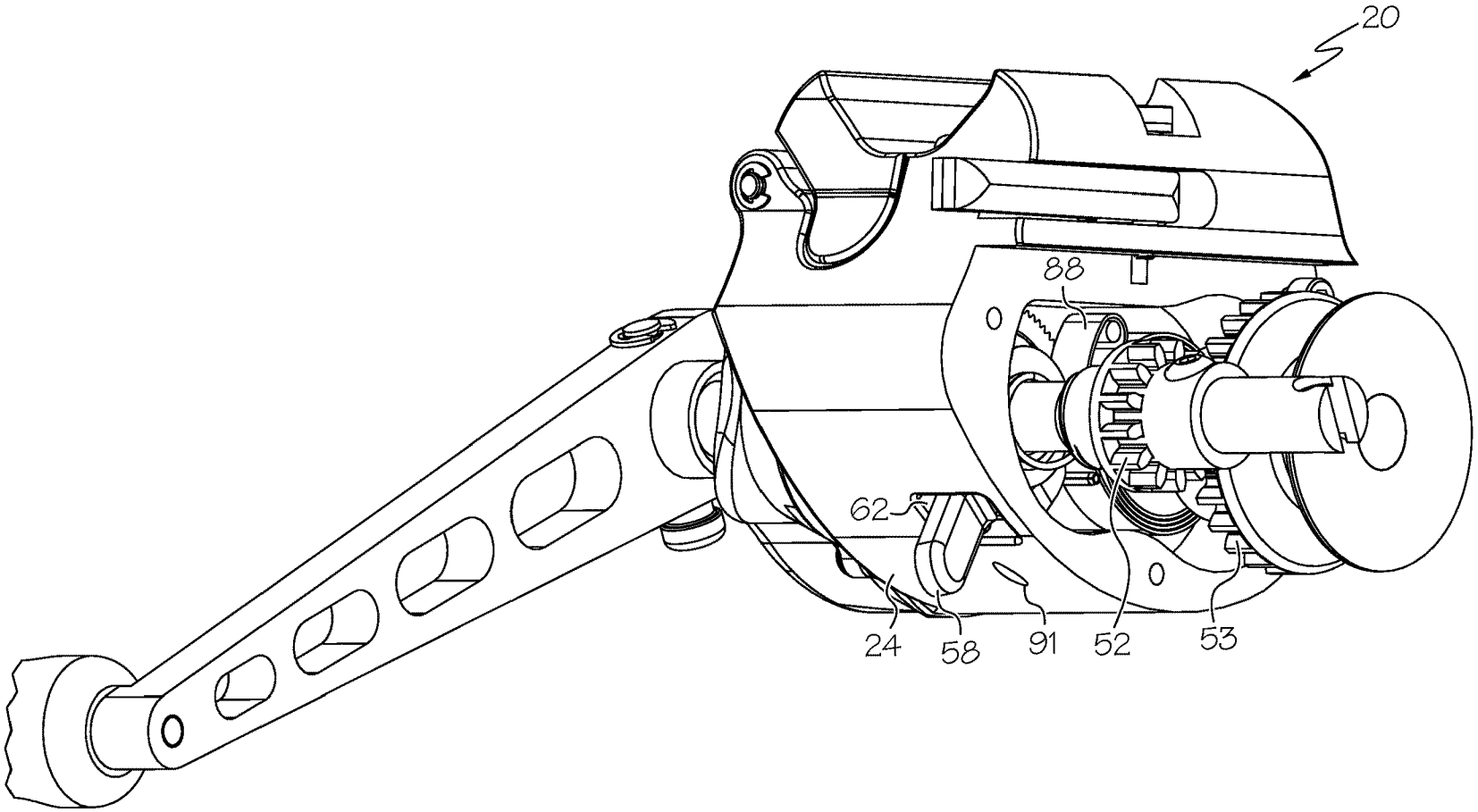

FIG. 22 shows the embodiment of FIG. 21 from a different angle, with the housing cover 27 and side covers 83 removed.

In some embodiments, each side cover 83 is arranged to cover a spool 42 and first and second shaft gears 52, 53. In some embodiments, a side cover 83 comprises an aperture 84, and a cocking string 22 (see e.g. FIG. 1) passes through the aperture 84. In some embodiments, an aperture 84 comprises a guide slot 85, and the shape of the guide slot 85 encourages the cocking string 22 to wind properly upon a spool 42. As a crossbow 10 is drawn with the crank 20 from a brace condition to a drawn condition, the orientation of the cocking string 22 with respect to the crank 20 changes. For example, the cocking string 22 may leave the crank 20 at a continuously higher angle as the crossbow 10 reaches a higher level of draw.

In some embodiments, a guide slot 85 is configured such that the cocking string 22 will traverse a length of the guide slot 85 during the cranking operation. For example, when the crossbow 10 is in a brace condition, a cocking string 22 may be oriented near a first end 86 of the guide slot 85. During cranking/draw of the crossbow 10, the cocking string 22 will traverse along the length of the guide slot 85, eventually being oriented near a second end 87 of the guide slot 85 at full draw. A shape of the guide slot 85 along its length can encourage the cocking string 22 to spool properly during cranking. A change in the lateral orientation of the guide slot 85 can cause the portions of the side cover 83 that define the guide slot 85 to contact and bias the cocking string 22. Thus, a non-linear guide slot 85 can be used. In some embodiments, a guide slot 85 comprises curvature along its length, a first linear portion oriented at an angle to a second linear portion, or various combinations thereof.

Figure 28:
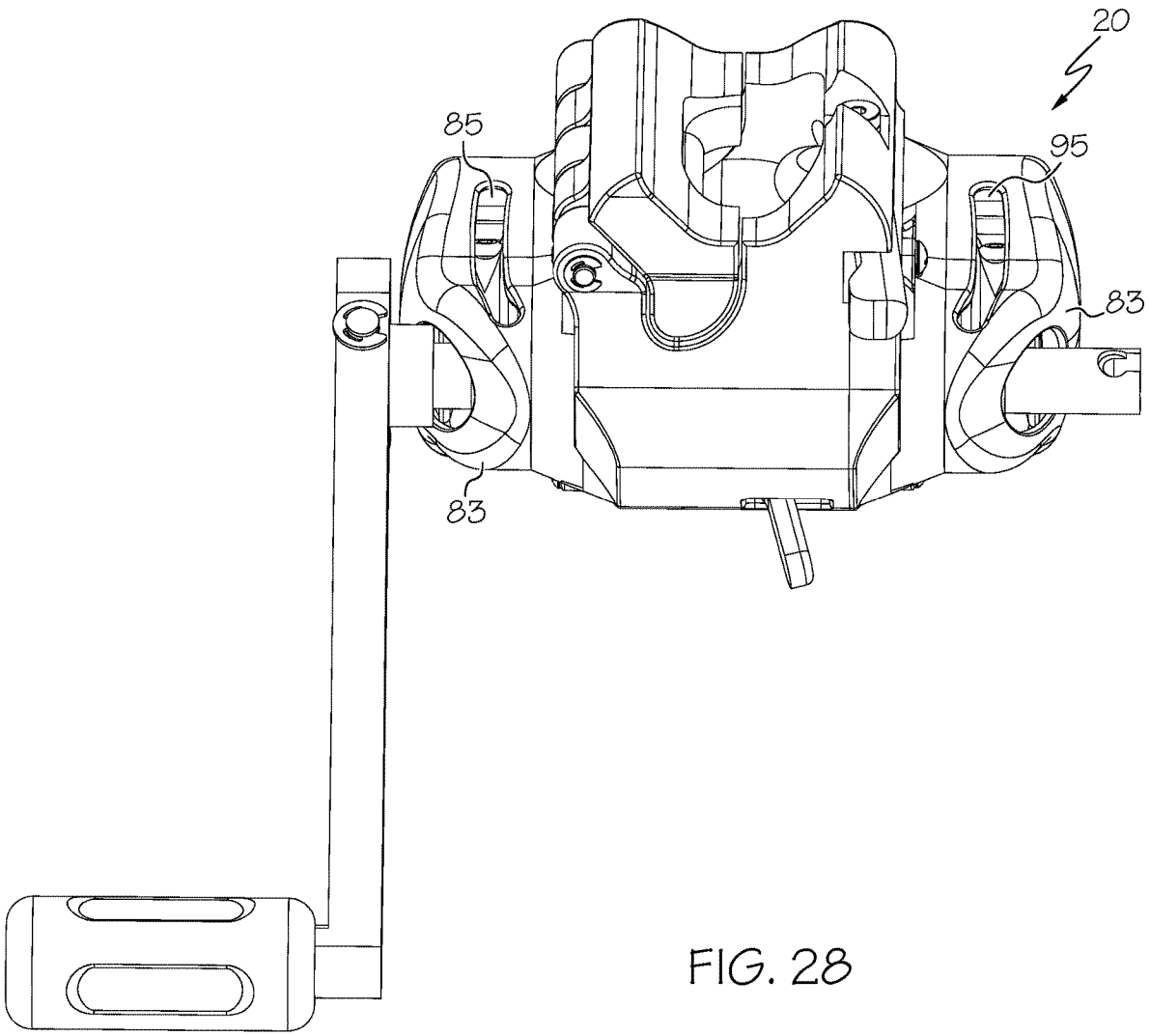
FIG. 28 shows an embodiment of a crossbow crank.

In some embodiments, a guide slot 85 is provided for each spool 42, 43. FIG. 28 shows an embodiment having a first guide slot 85 and a second guide slot 95, wherein a shape of the second guide slot 95 is a mirror image of the first guide slot 85.

Figure 23:
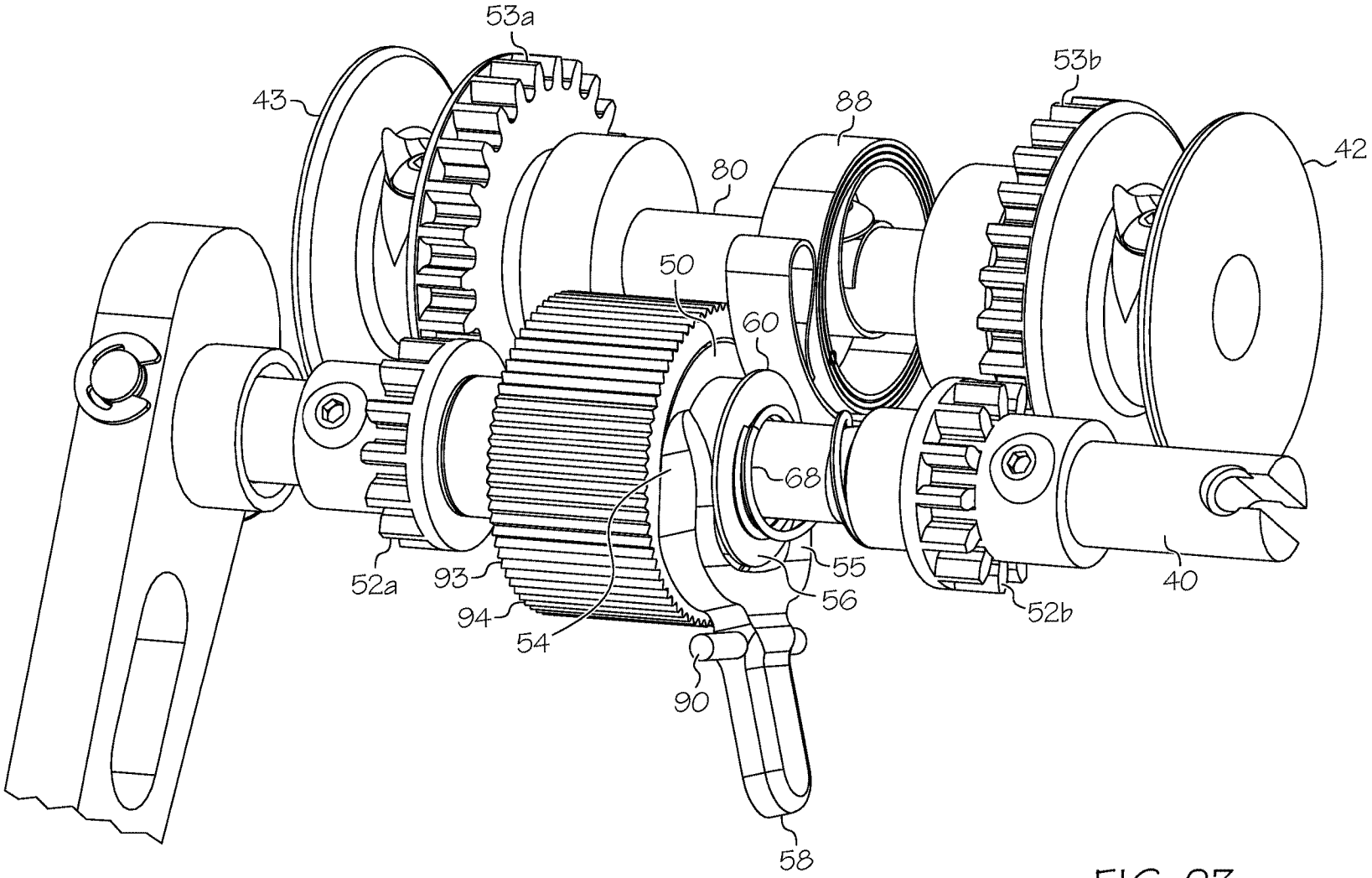

FIG. 23 shows the embodiment of FIG. 21 with the housing removed. In some embodiments, a release lever 58 is arranged to pivot with respect to another portion of the crank 20. As shown in FIGS. 22 and 23, the release lever 58 is arranged to pivot with respect to the housing 24. For example, in some embodiments, the release lever 58 receives a pivot pin 90 that defines a pivot axis for the release lever 58. A pivot pin 58 can be press fit into the housing 58, for example being inserted through an installation bore 91 in the housing. In some embodiments, the pivot pin 90 extends across the aperture 62 in the housing 24 provided for the release lever 58.

In some embodiments, a release lever 58 comprises a first prong 54 and a second prong 55. In some embodiments, a first prong 54 and second prong 55 comprise a U-shaped structure.

In some embodiments, a release lever 58 comprises a first portion 54 and a second portion 55 oriented on opposite sides of the shaft 40, wherein each portion 54, 55 is arranged to contact the release mechanism 56. As shown in FIG. 23, pivoting the release lever 58 about the pivot pin 90 causes the first and second portions 54, 55 to apply a lateral force to the flange 60 of the release mechanism 56, thereby moving the release mechanism 56 along the length of the shaft 40, releasing the one way mechanism 50 as previously described herein.

FIG. 23 also shows a sleeve 93 that is used in conjunction with the one way mechanism 50. In some embodiments, the one way mechanism 50 is press fit into the sleeve 93. In some embodiments, the sleeve 93 is molded into the housing 24 prior to receiving the one way mechanism 50. In some embodiments, a sleeve 93 comprises surface features 94 such as raised portions, teeth, knurling, etc., to help secure the sleeve 93 in the housing.

In some embodiments, any gear described herein can comprise a flange for added strength. For example, any of the first shaft gears 52*a*, 52*b* and second shaft gears 53*a*, 3*b* can comprise a flange. As shown in FIG. 23, each of the first shaft gears 52*a*, 52*b* comprises a flange 96, as well as a collar portion 97 secured to the shaft 40 with a fastener.

In some embodiments, a crank 20 comprises a retraction spring 88 arranged to bias the spools 42, 43 in a predetermined direction. Desirably, the retraction spring 88 is arranged to automatically retract a cocking string 22, for example when the crank 20 is not in use. In some embodiments, the retraction spring 88 provides a force that will help an operator to draw the bowstring. In some embodiments, the retraction spring 88 comprises a first portion 98 secured to the housing 24 and a second portion 99 secured to a shaft (e.g. 40 or 80). A retraction spring 88 can be arranged to bias either shaft 40, 80. In some embodiments, a retraction spring 88 biases a shaft 40, 80 upon which the spools 42, 43 are mounted.

FIG. 21 shows an alternative embodiment of a moveable wall member 30 that comprises a portion of a quick release mechanism, for example as previously discussed with respect to FIG. 3. The wall member 30 remains rotatable about axis 72, but the wall member 30 comprises a key 32 that is arranged to abut the housing 24 and limit travel of the wall member 30. A torsion spring 35 is also provided to bias the wall member 30 with respect to the housing 24 (for example biased toward an open configuration).

Figure 24:
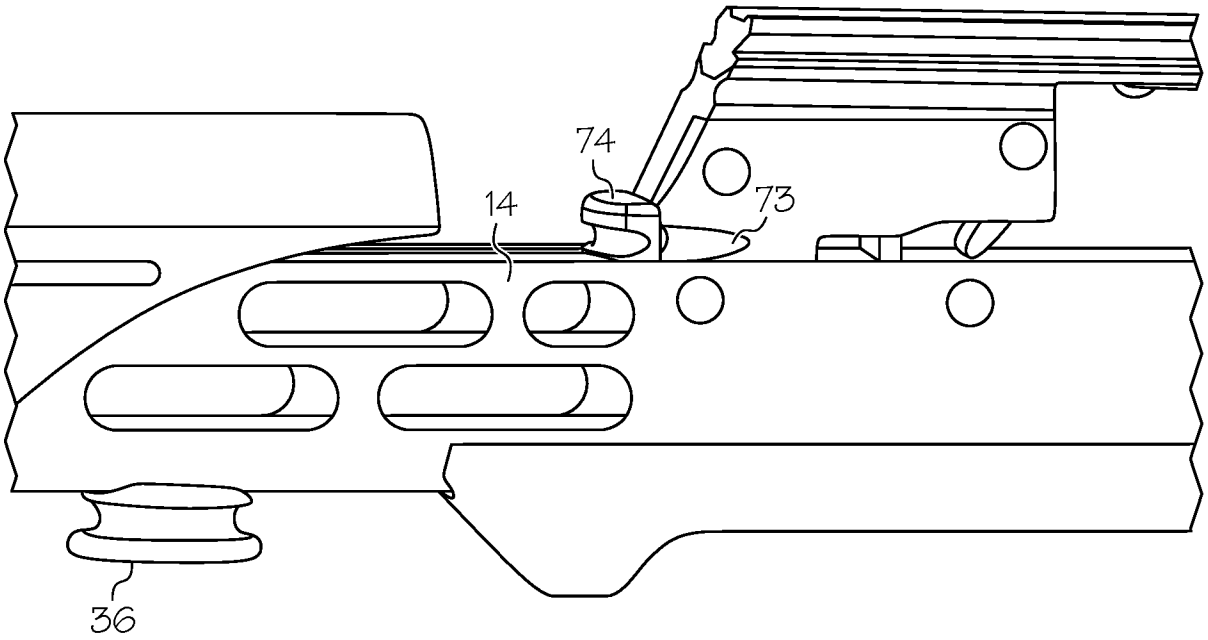
FIG. 24 shows an embodiment of a string centering device attached to a crossbow.

FIG. 24 shows a portion of an embodiment of a crossbow 10. A string centering device 74 as shown in FIG. 21 is shown attached to the stock 14.

In some embodiments, a string centering groove 73 can be provided as built into the crossbow 10, for example being formed in the string catch housing, site mount, rear butt of the crossbow or any other suitable location.

Figure 30:
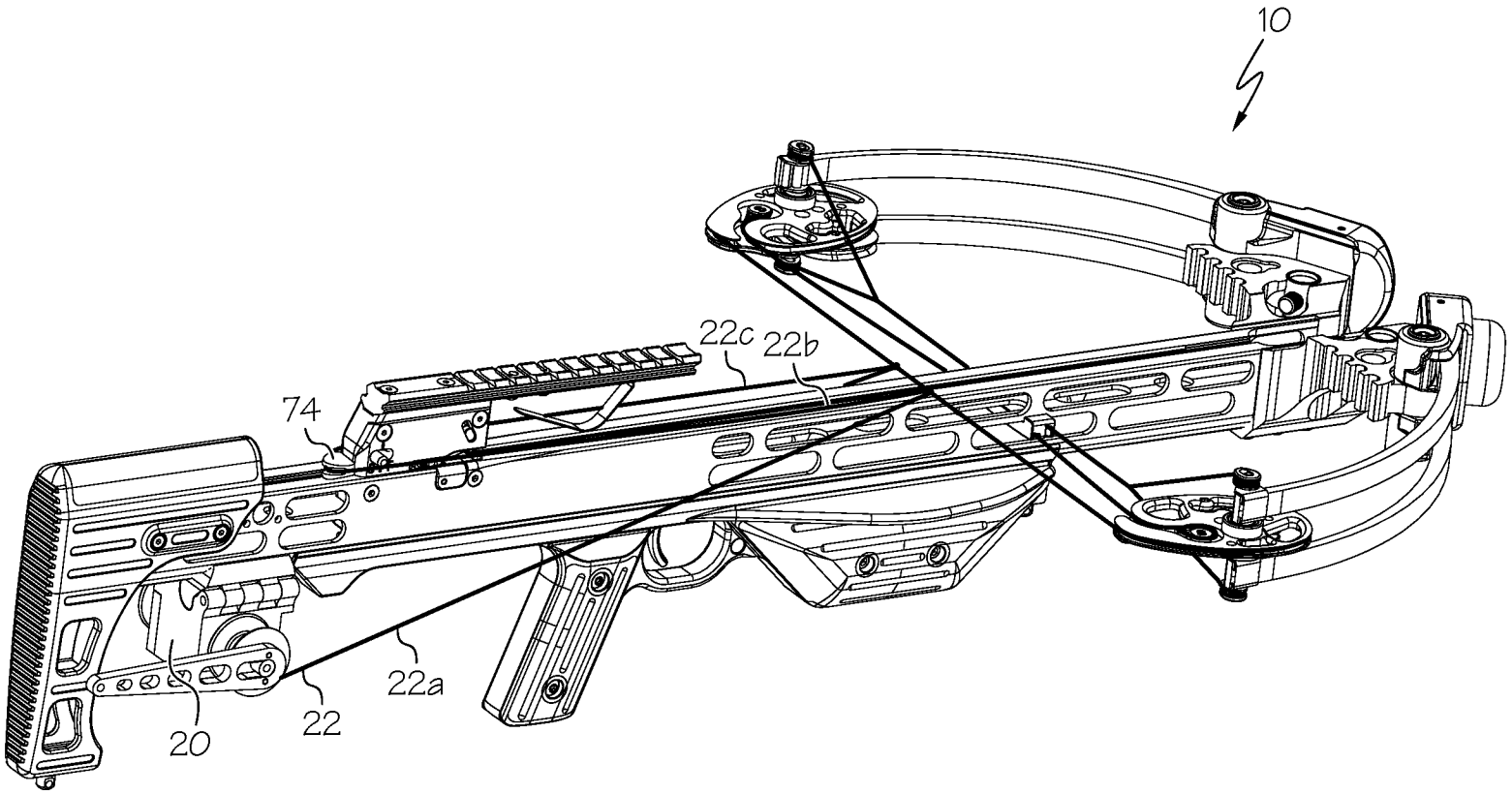
FIG. 30 shows another arrangement of a cocking string attached between the bowstring and crossbow crank.

When either a string centering device 74 or string centering groove 73 is used, the cocking string 22 can be anchored to the string centering device 74 or string centering groove 73 as the crossbow is drawn, for example as shown in FIG. 30. Anchoring a portion of the cocking string 22 to a string centering device 74 or string centering groove 73 that is supported by the crossbow 10 will apply forces to the crossbow and reduce the amount of force applied to the crank 20 and crank anchor 36 when compared to an arrangement as shown in FIG. 29.

Figure 25:
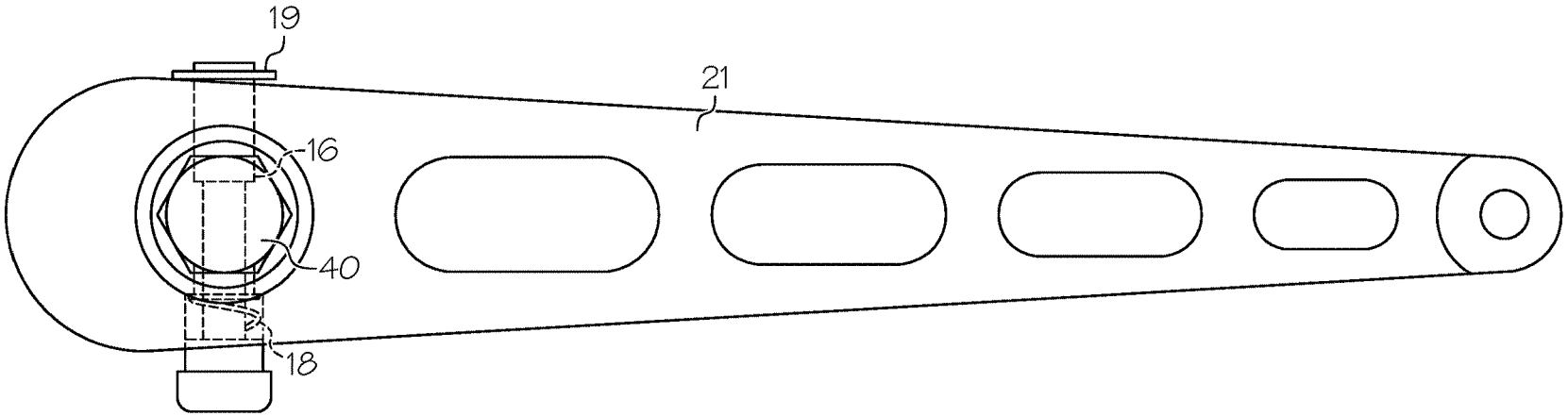
FIGS. 25-27 show a quick release attachment between a crank arm and a shaft.
Figure 26:
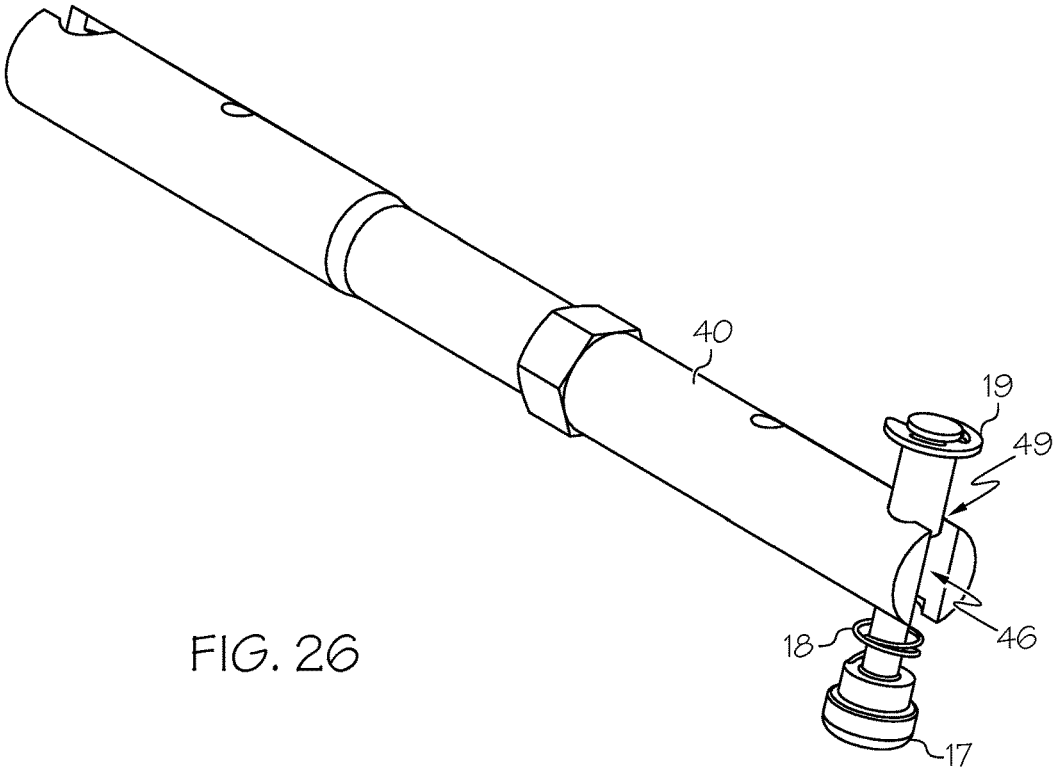
Figure 27:
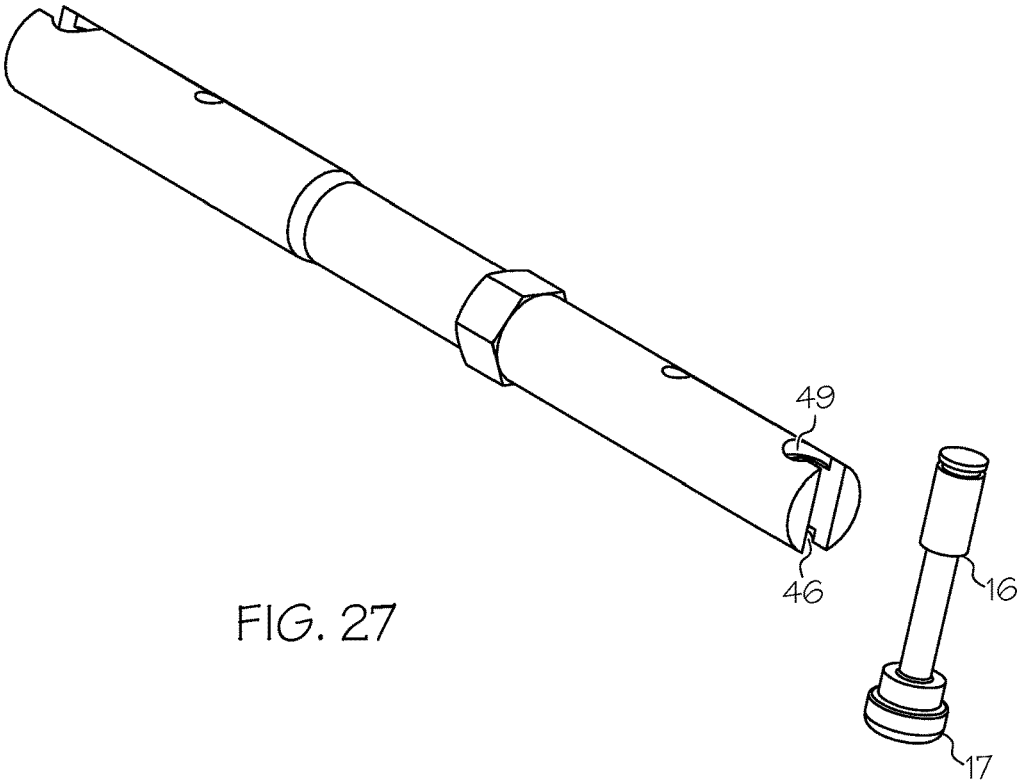

FIGS. 25-27 show an embodiment of a quick release crank arm 21. In some embodiments, the crank arm 21 is attached to the shaft 40 via a moveable pin 17. The moveable pin 17 is received in the crank arm 21 and is moveable between first and second positions. A spring 18 can bias the moveable pin 17 towards the first position, and a clip 19 can be used to retain the moveable pin 17 and spring 18 on the crank arm 21. In some embodiments, the moveable pin 17 comprises a flange 16 arranged to engage the shaft 40.

FIG. 26 omits the crank arm 21 for clarity but shows the moveable pin 17 in the first position and engaged to the shaft 40. FIG. 27 shows the pin 17 removed from the shaft 40. Desirably, the shaft 40 comprises a cavity 46 arranged to receive the pin 17. The shaft 40 further comprises a recess 49, which can comprise an enlarged portion of the cavity 46. Desirably, the flange 16 moves into the recess 49 when the moveable pin 17 is in the first orientation, thereby locking the pin 17 to the shaft 40. To release the crank arm 21, the pin 17 is simply depressed, moving the pin 17 to its second position, wherein the flange 16 moves out of the recess 49, allowing the pin 17 to disengage the shaft 40.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow crank comprising:

a housing;

a shaft rotatable with respect to said housing;

a roller clutch mechanism arranged to allow rotation of said shaft in one rotational direction; and a release mechanism arranged to disengage said roller clutch from said shaft, the release mechanism comprising a sleeve surrounding the shaft, the roller clutch surrounding the sleeve.

2. The crossbow crank of claim 1, wherein the crossbow crank does not include a pawl.

3. The crossbow crank of claim 1, wherein the roller clutch surrounds the shaft and the housing surrounds the roller clutch.

4. A crossbow crank comprising:

a housing;

a shaft rotatable with respect to said housing;

a one-way mechanism arranged to prevent rotation of said shaft in a first rotational direction, the one-way mechanism surrounding the shaft, the one-way mechanism engaged with the housing; and a release mechanism arranged to disengage the one-way mechanism from the shaft, the release mechanism comprising a sleeve surrounding the shaft, the one-way mechanism surrounding the sleeve.

5. The crossbow crank of claim 4, wherein the crossbow crank does not include a pawl.

6. The crossbow crank of claim 4, wherein the one-way mechanism comprises a roller clutch.

7. The crossbow crank of claim 4, comprising a crank arm engaged to the shaft.

8. The crossbow crank of claim 7, comprising a moveable pin arranged to release said crank arm from said shaft.

9. The crossbow crank of claim 4, wherein the release mechanism pivots with respect to said housing.

10. The crossbow crank of claim 4, comprising a biasing member arranged to bias said release mechanism to an engaged position.

11. The crossbow crank of claim 4, wherein said shaft comprises a first spool and a second spool oriented on opposite sides of the shaft.

12. The crossbow crank of claim 4, said release mechanism comprising a sleeve that surrounds said shaft.

13. The crossbow crank of claim 12, wherein said sleeve comprises a non-circular inner surface.

14. The crossbow crank of claim 4, the sleeve arranged to move along a length of the shaft.

15. A crossbow crank comprising:

a housing;

a shaft rotatable with respect to said housing;

a one-way mechanism arranged to prevent rotation of said shaft in a first rotational direction, the one-way mechanism surrounding the shaft, the one-way mechanism engaged with the housing;

a release mechanism arranged to disengage the one-way mechanism from the shaft; and a retraction spring arranged to bias said shaft in a second rotational direction, the retraction spring comprising a strip of material wrapped around the shaft.

* * * * *